US009969605B2

(12) United States Patent
Geipel et al.

(10) Patent No.: US 9,969,605 B2
(45) Date of Patent: May 15, 2018

(54) LIQUID NATURAL GAS GUN-STYLE NOZZLE

(71) Applicant: ACD, LLC, Santa Ana, CA (US)

(72) Inventors: Mark Geipel, Laguna Niguel, CA (US); Sam Safi, Eastvale, CA (US)

(73) Assignee: ACD, LLC, Santa Ana, CA (US)

( * ) Notice: Subject to any disclaimer, the term of this patent is extended or adjusted under 35 U.S.C. 154(b) by 34 days.

(21) Appl. No.: 15/130,711

(22) Filed: Apr. 15, 2016

(65) Prior Publication Data

US 2017/0101304 A1 Apr. 13, 2017

Related U.S. Application Data

(60) Provisional application No. 62/148,056, filed on Apr. 15, 2015.

(51) Int. Cl.
*B67D 7/42* (2010.01)
*F17C 5/02* (2006.01)

(52) U.S. Cl.
CPC ..... *B67D 7/42* (2013.01); *F17C 5/02* (2013.01); *F17C 2205/0376* (2013.01); *F17C 2221/033* (2013.01); *F17C 2250/00* (2013.01)

(58) Field of Classification Search
CPC ..... B67D 7/42; F17C 2205/0376
USPC ..... 141/206–211
See application file for complete search history.

(56) References Cited

U.S. PATENT DOCUMENTS 5,404,909 A 4/1995 Hanson
6,196,280 B1 3/2001 Tate, Jr. et al.
6,343,630 B1 2/2002 Dubinsky
6,401,767 B1 6/2002 Cohen et al.
8,596,315 B2 12/2013 Muller
8,863,791 B2 * 10/2014 Aehle ..... F17C 5/02 141/198
9,783,406 B2 * 10/2017 Torngren ..... B67D 7/42
2013/0099483 A1 4/2013 Weh et al.
2013/0327439 A1 12/2013 Pitney

OTHER PUBLICATIONS

Weh Technologies Inc., Type TK17 CNG: CNG Fueling Nozzle, Data Sheet, 6 pages, Feb. 2013.

* cited by examiner

*Primary Examiner* — Timothy L Maust
*Assistant Examiner* — Timothy P Kelly
(74) *Attorney, Agent, or Firm* — SoCal IP Law Group LLP; Guy L. Cumberbatch; Mark A. Goldstein

(57) ABSTRACT

There is disclosed a high pressure dispensing nozzle for providing cryogenic fuel such as liquid natural gas (LNG) from a source to a filling receptacle, such as on a vehicle. The nozzle has a gun-style nozzle construction and a plurality of jaw members provided near a distal end for locking engagement with the filling receptacle. The nozzle further has a movable internal poppet to establish a fuel passageway through the nozzle for delivery of fuel therethrough. Two different triggers enable separate steps of locking of the nozzle onto the filling receptacle and initiating gas flow for ease of use. The two steps may also me combined and actuated by a single trigger. One nozzle disclosed includes a safety button for dispersing residual gas in the nozzle prior to disengagement to help avoid injury to the user.

7 Claims, 22 Drawing Sheets

©2016 ACD, LLC

©2016 ACD, LLC

©2016 ACD, LLC

©2016 ACD, LLC

©2016 ACD, LLC

©2018 ACD, LLC

©2016 ACD, LLC

©2016 ACD, LLC

©2016 ACD, LLC

©2016 ACD, LLC

©2016 ACD, LLC

©2016 ACD, LLC

©2016 ACD, LLC

©2016 ACD, LLC

©2016 ACD, LLC

©2016 ACD, LLC

LIQUID NATURAL GAS GUN-STYLE NOZZLE

RELATED APPLICATIONS

The present application claims priority under 35 U.S.C. § 119 to U.S. Provisional Patent Application No. 62/148,056, filed Apr. 15, 2015.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to a high pressure filling nozzle for dispensing cryogenic gaseous fluids from a source to a filling receptacle, and, in particular, to a gun-style pressure-locking nozzle that separates the steps of connecting the source to the filling receptacle and initiating gas flow thereto, and a nozzle with a safety feature.

Description of the Related Art

Recent years have experienced a growing desire for natural gas-powered vehicles (NGV) and advances in the design and provision of such types of vehicles. Effective use of such types of vehicles, however, requires means to safely and reliably fuel and refill fuel tanks of such vehicles with compressed natural gas (CNG) such as Liquid Natural Gas (LNG). LNG is the primary fuel source for NGVs, and is stored and delivered at high pressures and cryogenic temperatures (below −150° C., −238° F. or 123 K), typically around −260° F. and at 250 psi.

Various standards for safely and reliably fueling and refilling fuel tanks include the standards for Type 2 and 3 nozzles as set forth in ANSI/CSA NGV1-2006 Standard for Compressed Natural Gas Vehicle (NGV) Fueling Connection Devices. That standard addresses design profiles for such fueling connection devices, as well as the standardized forces associated with connection (or coupling) and disconnection (or uncoupling) of a nozzle from a receptacle at the low and high pressures encountered during fueling processes. Nozzles are available in the industry from Parker Hannifin Corp. of Cleveland, Ohio (http://www.parker-.com), Macro Technologies (based out of RegO/Cryoflow Products) in Burlington, N.C. (http://macrotechnologi-es.com/LNG_Nozzle.htm), JC Carter LLC, of Costa Mesa, Calif. (http://www.jccarternozzles.com/images/pdf/NOZZLE_50_GPM.pdf), and ACD LLC of Santa Ana, Calif. (http://www.acdcom.com/engineered-solutions.html).

Despite more interest in NGVs and consequent advances in refilling nozzles therefor, there remains a need for an easier and more controllable refilling nozzle.

SUMMARY OF THE INVENTION

In one embodiment, the present application discloses a high pressure filling nozzle for one-handed dispensing of cryogenic gaseous fluids into a filling receptacle having a tubular extension and a spring-biased plug therein. The nozzle comprises a gun-style housing having a proximal handle through which passes a gas conduit terminating in a connector for a pressurized gas supply and a distal barrel portion angled with respect to the handle and aligned in a proximal-distal direction, the distal barrel portion terminating in an outlet end sized to receive the tubular extension of the filling receptacle. A valve assembly fixed with respect to the proximal handle is adapted to slide within and along the barrel portion, the valve assembly having a proximal end open to the gas conduit and an internal poppet at a distal end that is biased into a closed position by an internal spring. A locking trigger mounts to a pivot point so as to enable pivoting toward and away from the handle and is connected to the valve assembly and barrel portion in a manner such that squeezing the locking trigger displaces the valve assembly in a distal direction within the barrel portion and toward the outlet end. The locking trigger is adapted to be actuated by one hand by a person squeezing the trigger and the handle. A distal latch housing forms a part of the barrel portion and surrounds the valve assembly, the latch housing having a plurality of clamping jaws that engage and lock to the tubular extension of the filling receptacle when the valve assembly is displaced in a distal direction within the barrel portion and toward the outlet end. The valve assembly also contacts and displaces the spring-biased plug in the filling receptacle at the same time that the clamping jaws engage. A flow control trigger is adapted to displace the poppet in the valve assembly in a proximal direction against the force of the internal spring to enable a flow of cryogenic gas through the filling receptacle.

The locking trigger pivot point is desirably fixed with respect to the valve assembly such that the locking trigger moves with the valve assembly, and also may have an upper finger engaged with a cam slot fixed with respect to the barrel portion. The latch housing preferably includes a mechanism for each clamping jaw that coordinates movement of the valve assembly with movement of the clamping jaws. The mechanism features a pivoting latch member that extends inward to interfere with two shoulders on an exterior of the valve assembly that contact and displace the latch member in proximal and distal directions, wherein an outer end of the latch member rotatably connects to a link arm which is also rotatably journaled to an associated clamping jaw. There are preferably three clamping jaws and associated mechanisms within the latch housing.

The nozzle further may have a safety member on the handle that is actuated to hold the locking trigger pivoted toward the handle. The nozzle also may have a locking tab on the flow control trigger that is rotated into a position to lock the flow control trigger in a position that holds the poppet in the valve assembly in a proximal direction. Preferably, the flow control trigger pivots about a point fixed with respect to the handle and is smaller and located closer to the handle than the locking trigger.

The latch housing desirably defines the outlet end of the nozzle housing and is fixed with respect to a generally tubular cam housing that fits within an inner bore of the latch housing to together define the barrel portion of the gun-style housing. A throughbore of the cam housing preferably receives a tubular horizontal portion of the valve assembly that houses the poppet, the nozzle further including a tubular downwardly-angled gas conduit that extends through the handle and terminates in the connector. Finally, a tubular horizontal portion of the valve assembly preferably terminates in a distal nose that contacts and displaces the spring-biased plug in the filling receptacle when the valve assembly is displaced in a distal direction, the poppet being displaced with respect to the distal nose.

A second nozzle embodiment includes a high pressure filling nozzle for one-handed dispensing of cryogenic gaseous fluids into a filling receptacle having a tubular extension and a spring-biased plug therein. The nozzle exhibits a gun-style housing having a proximal handle through which passes a gas conduit terminating in a connector for a pressurized cryogenic gas supply angled with respect to a distal barrel portion aligned in a proximal-distal direction. The distal barrel portion terminates in an outlet end sized to receive the tubular extension of the filling receptacle and the handle and gas conduit being movable in the proximal-distal direction with respect to the barrel portion. A valve assembly is fixed with respect to the handle and is adapted to slide within and along the barrel portion. The valve assembly has a proximal end open to the gas conduit and an internal poppet at a distal end that is biased into a closed position by an internal spring. A locking trigger mounts to a pivot point so as to enable pivoting toward and away from the handle and is connected to the valve assembly and barrel portion in a manner such that squeezing the locking trigger displaces the valve assembly in a distal direction within the barrel portion and toward the outlet end. The locking trigger is adapted to be actuated by one hand by a person squeezing the trigger and the handle. Finally, a distal latch housing forming a part of the barrel portion and surrounding the valve assembly has a plurality of clamping jaws that engage and lock to the tubular extension of the filling receptacle when the valve assembly is displaced in a distal direction within the barrel portion and toward the outlet end. In use, displacement of the valve assembly in a distal direction within the barrel portion and toward the outlet end also opens both the spring-biased plug in the filling receptacle and the poppet in the valve assembly against the force of the internal spring to enable a flow of cryogenic gas through the filling receptacle.

The second nozzle locking trigger pivot point may be fixed with respect to the valve assembly such that the locking trigger moves with the valve assembly. Further, the locking trigger may have an upper finger pivotally connected to a linkage arm fixed with respect to the barrel portion.

The second nozzle latch housing desirably includes a mechanism for each clamping jaw that coordinates movement of the valve assembly with movement of the clamping jaws. The mechanism features a pivoting latch member that extends inward to interfere with a shoulder on an exterior of the valve assembly that contacts and displaces the latch member in a proximal direction to cause disengagement of an associated clamping jaw, wherein an outer end of the latch member rotatably connects to a link arm which is also rotatably journaled to an associated clamping jaw. There are preferably three clamping jaws and associated mechanisms within the latch housing, and the clamping jaws may each be spring biased into a position where they engage and lock to the tubular extension. Also, a second shoulder on the exterior of the valve assembly may contact and displace the latch members in a distal direction to cause engagement of the clamping jaws.

The second nozzle poppet extends to a distal end of a tubular horizontal portion of the valve assembly and terminates in a distal nose that extends distally from the valve assembly to directly contact the spring-biased plug in the filling receptacle when the valve assembly is displaced in a distal direction.

Figure 1:
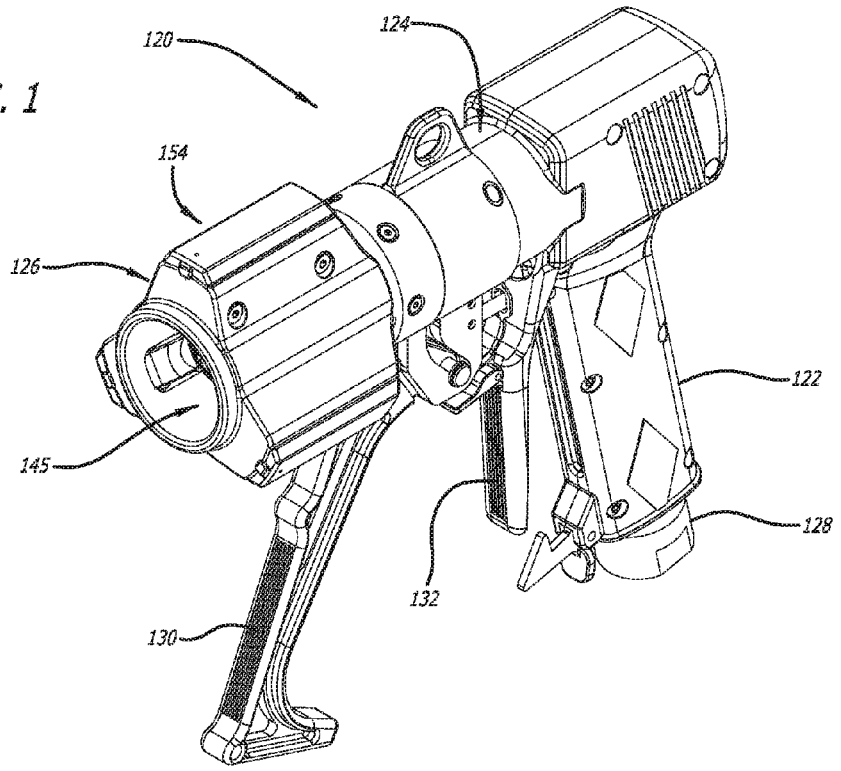
FIG. 1 is a frontal perspective view of an exemplary gun-style compressed natural gas nozzle of the present application.
Figure 2:
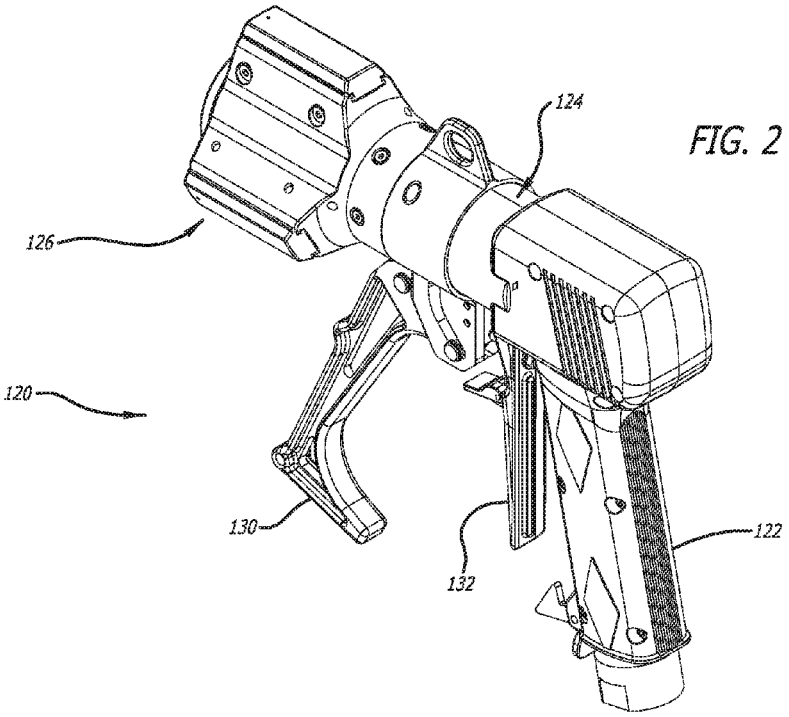
FIG. 2 is a rear perspective view of the gun-style compressed natural gas nozzle of FIG. 1.
Figure 3:
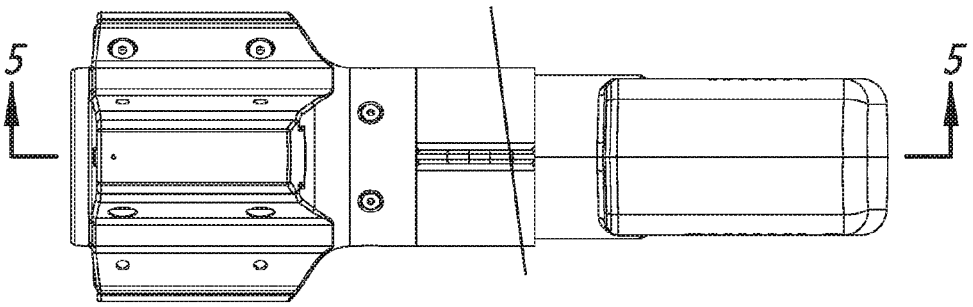
FIG. 3 is a top plan view and FIG. 4 is a side elevational view of the gun-style compressed natural gas nozzle of FIG. 1.
Figure 4:
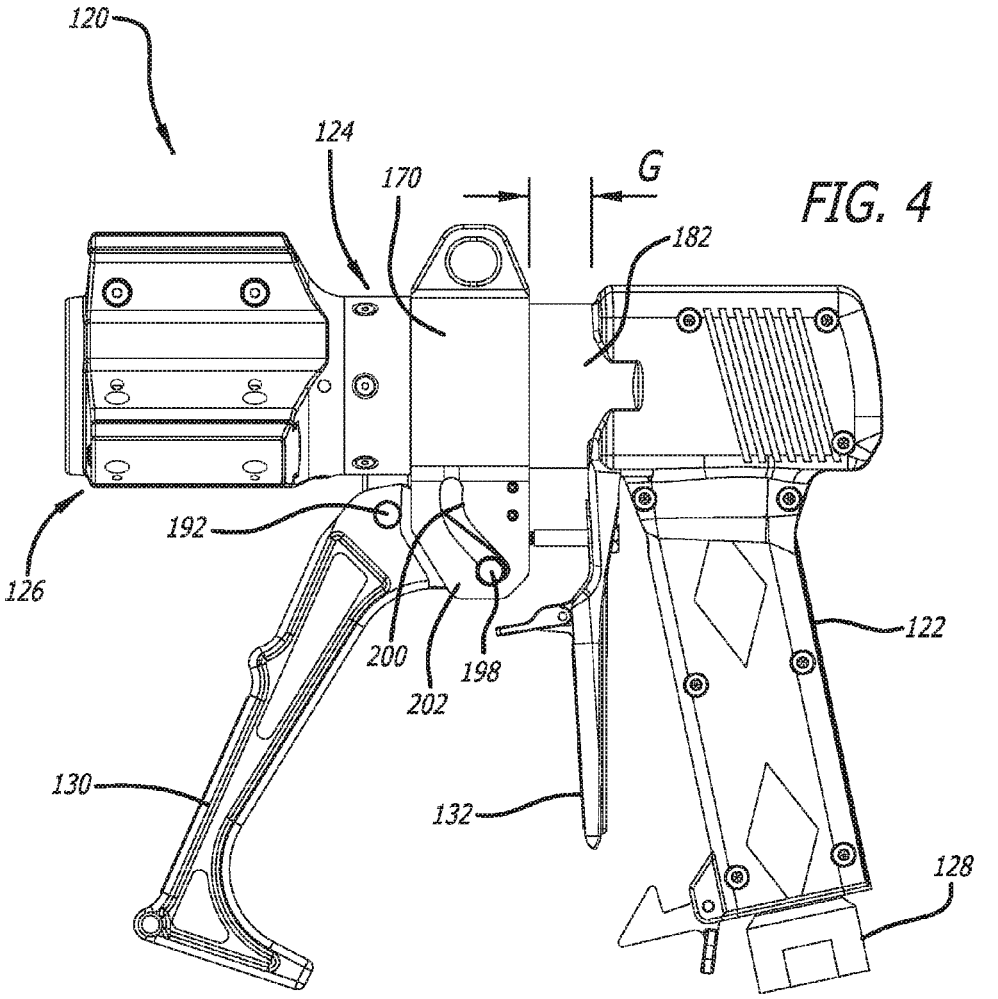

Throughout this description, elements appearing in figures are assigned three-digit reference designators, where the most significant digit is the figure number where the element is introduced and the two least significant digits are specific to the element. An element that is not described in conjunction with a figure may be presumed to have the same characteristics and function as a previously-described element having the same reference designator.

DETAILED DESCRIPTION

The present application discloses an improved compressed natural gas nozzle for transferring pressurized cryogenic natural gas from a source to a filling receptacle. It may be an underground or aboveground stationery storage tank, or a storage tank mounted on a vehicle, for example. Likewise, the filling receptacle may be a variety of machines and vehicles, and the present application should not be considered limited to a particular source or recipient of the gas. In one particular embodiment, the source is a stationery storage tank for Liquid Natural Gas (LNG) at a centralized filling terminal, and the recipient is a fleet vehicle such as a commuter bus that utilizes LNG for propulsion.

Conventional nozzles for compressed natural gas typically include tubular connector that mates with a slightly smaller tubular filling receptacle having an outwardly projecting flange. The larger nozzle fits around the smaller filling receptacle. The user pivots a pair of opposed handles on the nozzle toward the filling receptacle which simultaneously locks the nozzle onto the flange of the filling receptacle and opens a channel for pressurized gas to flow from the source through the nozzle and filling receptacle to the tank of the vehicle being filled. When the tank is filled, the two handles are retracted to simultaneously shut off the flow of gas and release the nozzle from the filling receptacle.

The present application discloses a compressed natural gas nozzle which incorporates separate levers or triggers for locking the nozzle to a filling receptacle and for initiating the flow of compressed gas. In this manner, the nozzle can be locked on to the filling receptacle without the possibility of gas escaping, and after a proper seal is established the flow of gas can be commenced. The gas flow can then be shut off without releasing the nozzle from the filling receptacle, and turned on again if necessary. By being able to first shut off the flow of gas, unlocking and removal of the nozzle from the filling receptacle is facilitated and there is little or no pressurized gas remaining between the two mating components that might cause an accident.

In the detailed description, the terms proximal and distal refer to opposite directions along an axis defined as a horizontal axis of the compressed natural gas nozzles of the present application. Of course, the nozzles are not always oriented in a horizontal direction, the term being used in a relative sense with reference to the drawings. The horizontal axis may also be termed a longitudinal axis. Further, forward or front is synonymous with distal and backward or rear with proximal.

FIGS. 1-4 illustrate several views of an exemplary gun-style compressed natural gas nozzle 120 of the present application. The nozzle 120 has a gun-style with a handle 122 angled down and rearward from the back end of a horizontal barrel portion 124 that terminates at a forward outlet end 126. A connector 128 at the bottom of the handle 122 permits attachment of a compressed natural gas line or hose. In this regard, the gas flows up through the handle 122 and forward through the barrel portion 124 to the outlet end 126.

The gun-style nozzle 120 has a size that can easily be manipulated by an adult, and a pair of triggers 130, 132 that provide actuating levers for the nozzle. More particularly, a larger first lever or trigger 130 is mounted for pivoting movement under a mid-portion of the barrel portion 124 and enables locking of the nozzle 120 to a filling receptacle, as will be described. A smaller second lever or trigger 132 also pivots under the barrel portion 124 and controls the flow of gas through the nozzle. The first trigger 130 may be termed a locking trigger, while the second trigger 132 is alternately termed a flow control trigger.

Figure 5:
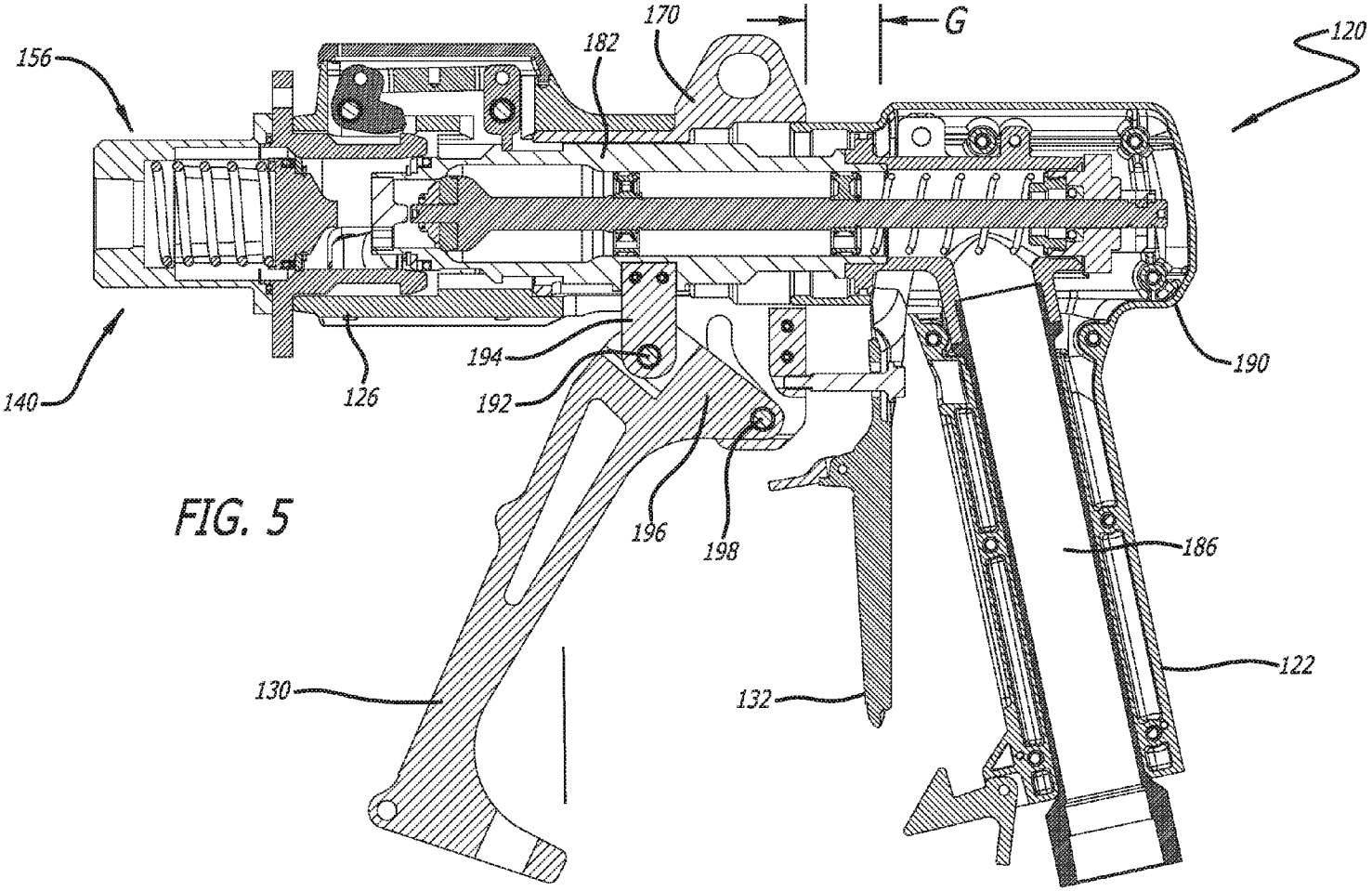
FIG. 5 is a vertical sectional view through the gun-style compressed natural gas nozzle taken along line 5-5 of FIG. 3 shown with an outlet end engaged with a filling receptacle.
Figure 5A:
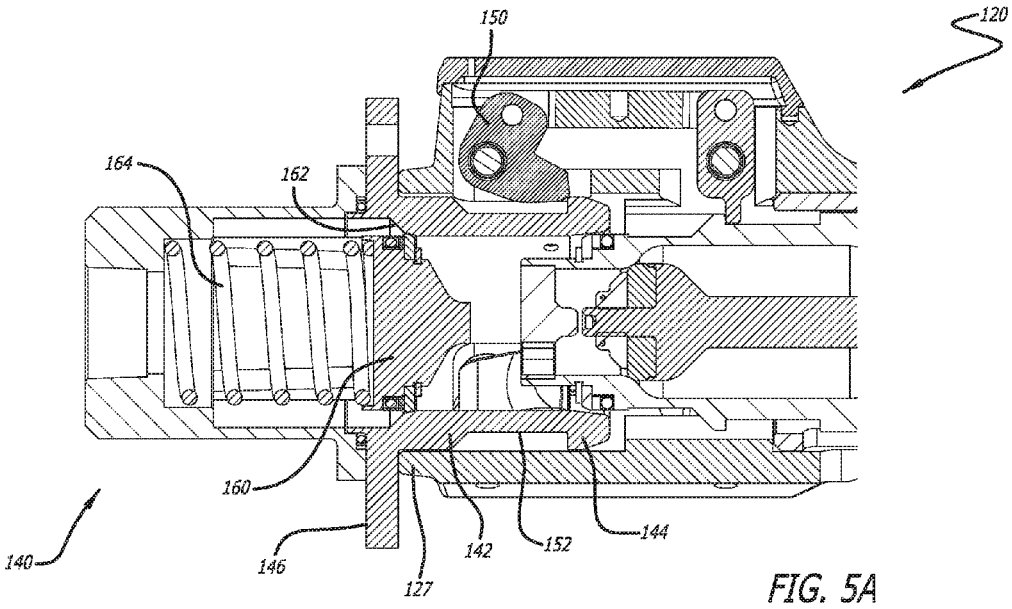
FIG. 5A is an enlarged view of the outlet end and filling receptacle engagement.

FIG. 5 is a vertical sectional view through the nozzle 120 shown with the outlet end 126 just prior to engagement with a filling receptacle 140, and FIG. 5A is an enlarged view of the outlet end and filling receptacle engagement. The filling receptacle 140 is representative of a number of different types of such receptacles, and typically includes a tubular extension 142 terminating in an annular flange 144. The tubular extension 142 is sized to fit within an inner bore 145 (FIG. 1) of the outlet end 126 of the nozzle 120 until a forwardmost extent 127 of the outlet end 126 abuts a large radial stop 146 marking the base of the tubular extension. At this point, a plurality of movable clamping jaws 150 (#8 in FIG. 8) on the nozzle 120 are positioned around an annular recess 152 in the tubular extension 142 adjacent to the flange 144. FIG. 1 shows three outward projections in a latch housing 154 (#1 in FIG. 8) surrounding the outlet end 126 at even 120° spacings, each of which encloses a mechanism for actuating the movable jaws 150, as will be explained below.

As seen in FIG. 5, the filling receptacle 140 further includes a generally tubular connector 156 leading to a passage, channel, or hose (not shown) through which the gas will flow toward the recipient vehicle. As best seen in FIG. 5A, a shutoff valve resides within the filling receptacle 140 comprising a plug member 160 having a one or more O-ring seals (not numbered) that contact an internal narrowing 162 and prevent flow of compressed gas through the receptacle by virtue of compression provided by a coil spring 164.

Figure 8:
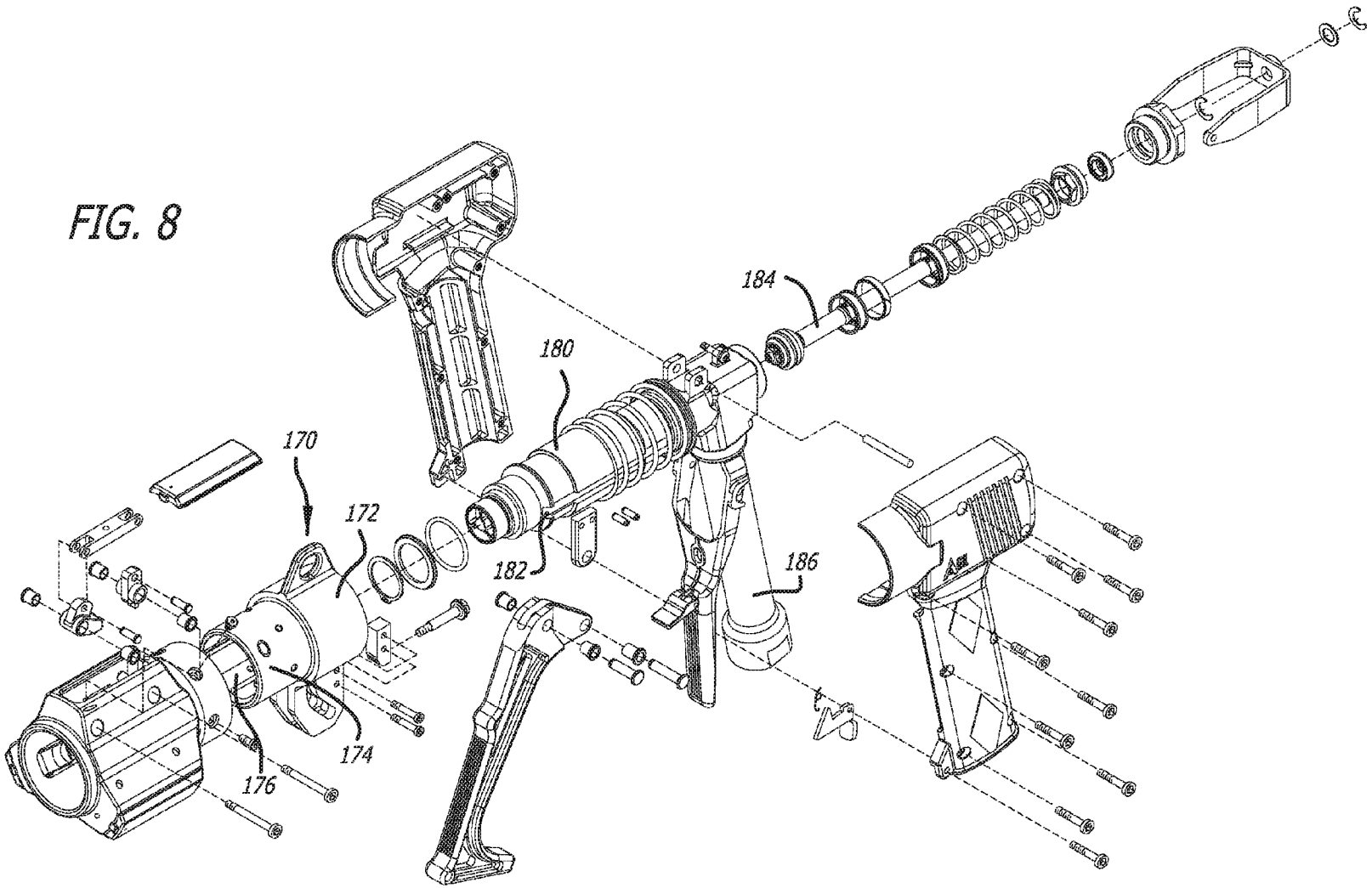
FIG. 8 is an exploded perspective view of components of the exemplary gun-style compressed natural gas nozzle of the present application.

With reference back to FIG. 4, and also FIG. 8, the nozzle 120 comprises a primarily tubular cam housing 170 (#2 in FIG. 8) having a rear collar 172 and a narrower forward extension 174 that fits within the an inner bore 145 (see FIG. 1) of the outlet end 126. The rear collar 172 is larger than the bore 145 and the cam housing 170 is fixed in position with respect to the outlet end 126 with bolts (#38 in FIG. 8). A throughbore 176 of the cam housing 170 (see FIG. 8) receives a forward end of a valve assembly 180 (#3 in FIG. 8). The valve assembly 180 includes a tubular horizontal portion 182 that houses a valve stem or poppet 184 (#5 in FIG. 8) and attendant valve components, and a tubular downwardly-angled portion 186 that extends through the handle 122 and terminates in the connector 128. A pistol housing 190 (#12 in FIG. 8) encloses and fastens around the valve assembly 180. The combination of the valve assembly 180 and pistol housing 190 is free to move a distance across gap G (see FIGS. 4 and 5) in a forward direction toward the assembly of the outlet end 126 and cam housing 170.

FIG. 5 shows the various components in section, and in particular the concentric assembly of the outlet end 126, cam housing 170, tubular horizontal portion 182 of the valve assembly 180, and pistol housing 190. An upper end of the first lever or trigger 130 pivots about a fulcrum pin 192 (#24 in FIG. 8) fixed within a downwardly-depending barrel tab 194 (#19 in FIG. 8). The barrel tab 194, in turn, is fixed to the underside of the horizontal portion 182 of the valve assembly 180 via rivets or the like. The trigger 130 further includes a finger 196 near the upper end thereof and spaced toward the handle 122 through which is fixed a cam pin 198 (#23 in FIG. 8). The cam pin 198 slides up and down within a non-linear angled slot 200 defined by a downward bracket 202 on the cam housing 170. The angled slot 200 is shown best in FIG. 4.

Figure 6:
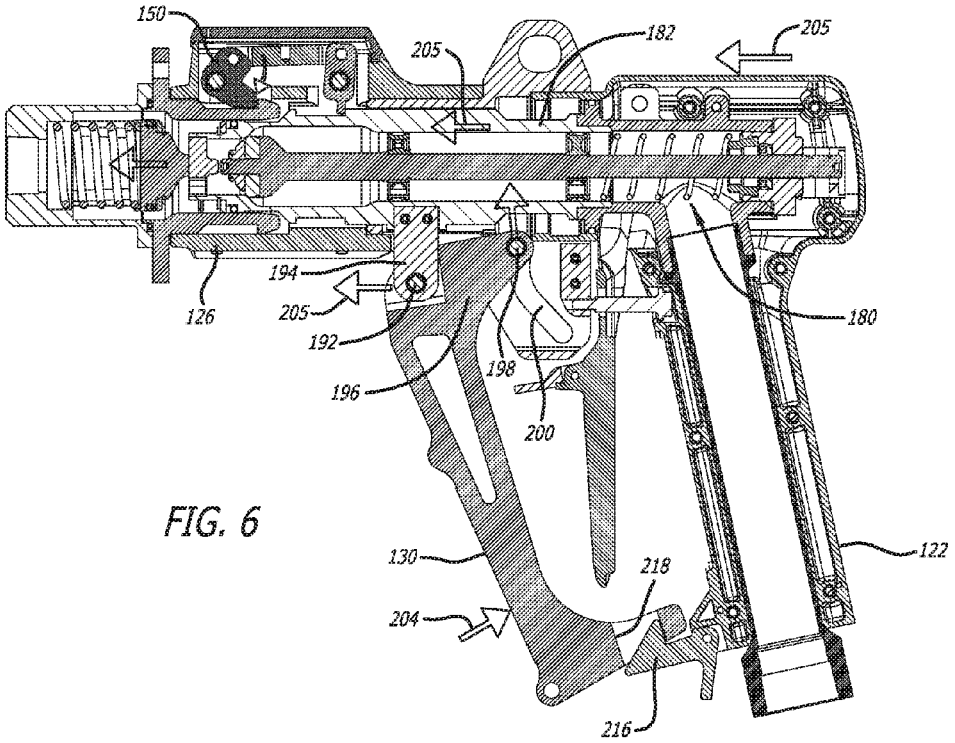
FIG. 6 is a vertical sectional view through the gas nozzle showing actuation of a first trigger for locking the nozzle to the filling receptacle.

Between FIGS. 5 and 6 the first lever or trigger 130 is pulled back in the direction of movement arrow 204 causing it to pivot about fulcrum pin 192. Since the angled slot 200 is formed in the cam housing 170 which is fixed with respect to the outlet end 126, pivoting the lever 130 causes the cam pin 198 to travel upward in the slot and the leverage of the finger 196 thus displaces the fulcrum pin 192, barrel tab 194, and, ultimately, the valve assembly 180 forward (or to the left as shown by the movement arrows 205). Actuating the first lever or trigger 130 causes two reactions: the nozzle 120 is locked to the filling receptacle 140 and the shutoff valve of the receptacle is opened.

As will be clear to one of skill in the art, the interaction between the first trigger 130, fulcrum pin 192, barrel tab 194, cam pin 198, and angled slot 200 is just one example of a system for displacing the valve assembly 180 with respect to the filling receptacle 140, and may be replaced by various mechanical levers or even electric devices. Preferably, one end of the trigger 130 is mounted to a pivot point fixed with respect to the valve assembly 180 while another part is connected to the barrel portion 124 fixed with respect to the outlet end 126, or vice versa, in a manner such that squeezing the locking trigger displaces the valve assembly in a distal direction within the barrel portion and toward the outlet end. Further, the locking trigger 130 is adapted to be actuated by one hand by a person squeezing the trigger and the handle 122. Indeed, the pivoting spring-loaded toggle member 384 is shown in an exemplary embodiment, but could also be replaced with a radially movable member, a gear mechanism, a solenoid, etc., and the term "toggle member" refers to these alternatives and others within the skill in the art.

Figure 6A:
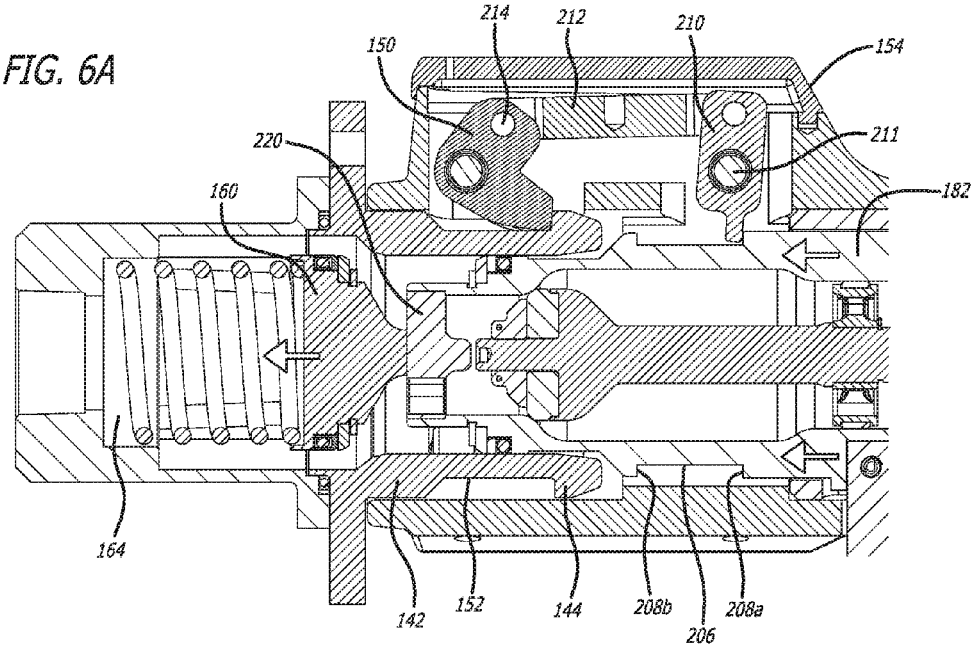
FIG. 6A is a corresponding view of the outlet end and filling receptacle engagement.

As seen in FIGS. 6, 6A and 8, the forward end of the horizontal portion 182 of the valve assembly 180 includes a cylindrical recess 206 between two shoulders 208*a*, 208*b*. A pivoting latch member 210 (#10 in FIG. 8) mounted to rotate about a radial axis pin 211 within each of the three segments of the latch housing 154 includes a lower end that extends into the recess 206 such that the two shoulders 208*a*, 208*b* may contact and displace it. An upper end of the latch member 210 rotatably connects to a link arm 212 (#9 in FIG. 8) which arm is also rotatably journaled to a pin 214 fixed to the associated clamping jaw 150. As seen in FIGS. 6 and 6A, forward movement of the valve assembly 180 causes the rear shoulder 208*a* to contact and rotate the latch member 210 in a clockwise (CW) direction, which in turn causes the clamping jaw 150 to also rotate clockwise such that a pawl end enters the annular recess 152 in the tubular extension 142 and interferes with the annular flange 144. The three jaws 150 thus prevent separation of the nozzle 120 and filling receptacle 140, at least as long as the first lever or trigger 130 remains pivoted toward the handle 122. FIG. 6 also shows a safety hook 216 (#14 in FIG. 8) on the handle 122 that may be rotated into an aperture 218 in the trigger 130 to hold it in place.

Actuating the first lever or trigger 130 also opens the shutoff valve of the filling receptacle 140. As seen best in FIG. 6A, a forward nose 220 of the horizontal portion 182 of the valve assembly 180 eventually contacts and displaces the plug member 160 against the spring 164 from its sealed contact with the inside of the filling receptacle 140. The nose 220 is a static member fixed in the horizontal portion 182 of the valve assembly 180. Given the relatively high spring constant of the spring 164, the first lever or trigger 130 is relatively large and employs a significant mechanical advantage via the cam action of the fulcrum pin 192 and cam pin 198. As mentioned above, although a large lever 130 and associated cams and linkages are shown, alternative locking actuators are contemplated, such as ones which utilizes a screw-type mechanical advantage as well as ones which include motorized or otherwise power-assisted technology.

Figure 7:
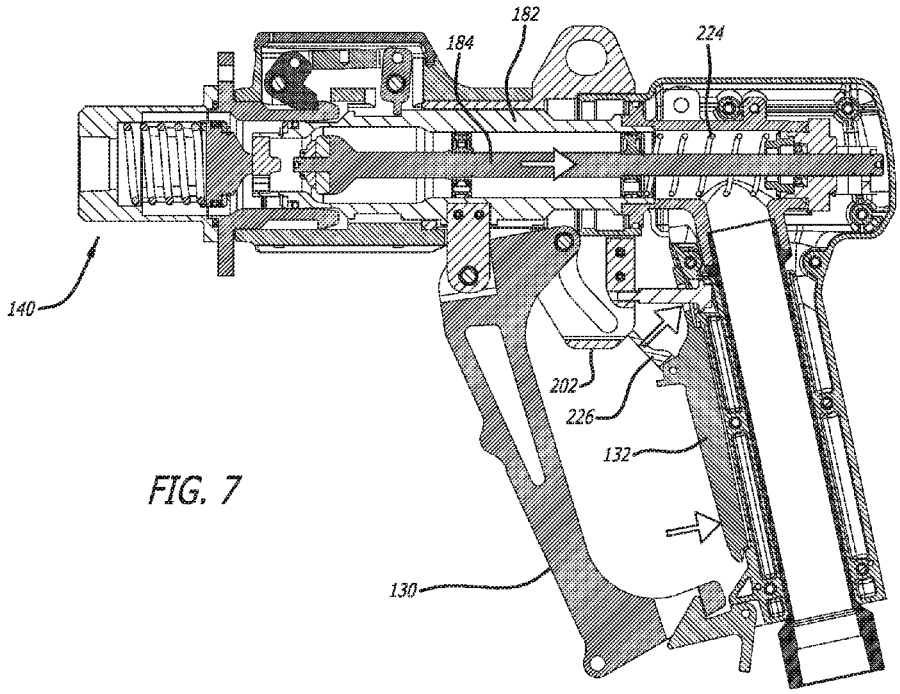
FIG. 7 is a vertical sectional view through the gas nozzle showing actuation of a second trigger for initiating gas flow to the filling receptacle.
Figure 7A:
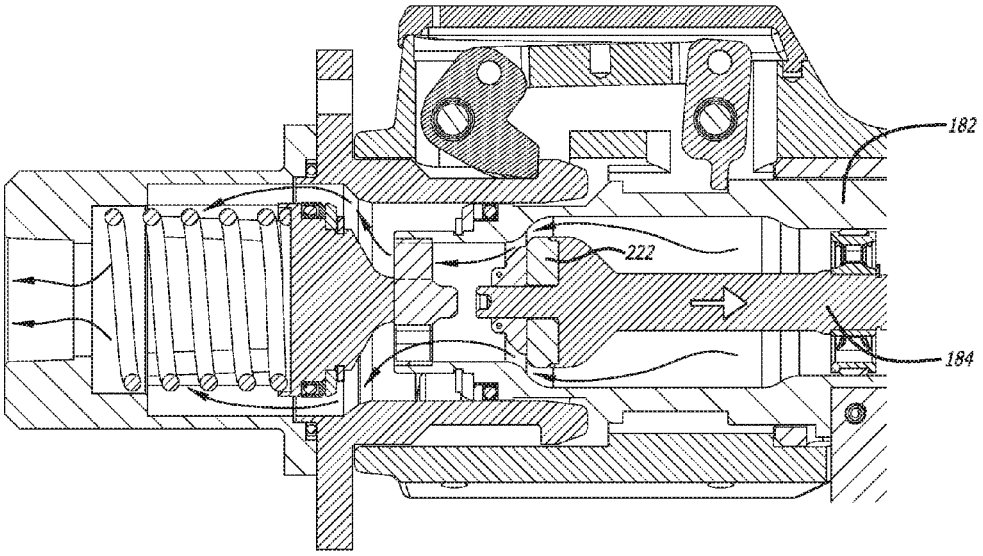
FIG. 7A is a corresponding view of the outlet end and filling receptacle engagement.

FIGS. 7 and 7A show actuation of the second lever or trigger 132 for initiating gas flow to the filling receptacle 140. Specifically, the trigger 132 displaces from its position in FIG. 6 to that of FIG. 7, and in the process retracts the valve stem or poppet 184 in a rearward direction, as seen by the movement arrows. The poppet 184 moves with respect to the forward nose 220 of the valve assembly 180 which holds open the plug member 160 of the filling receptacle 140, and although not shown, flow apertures between the poppet and nose or through the nose are provided. A forward end of the poppet 184 includes an annular seal 222 (#20 in FIG. 8) that contacts an internal shoulder of the horizontal portion 182 of the valve assembly 180 and prevents gas flow under compression of a spring 224 (see FIG. 7, #52 in FIG. 8). The poppet 184 is thus biased closed and will only open upon actuation of the trigger 132. Much like a standard gasoline refueling nozzle, the nozzle 120 also includes a locking tab 226 on the trigger 132 that can be rotated into a position braced against the downward bracket 202 on the cam housing 170, thus freeing the operator to monitor displays and such conveying real time refilling information.

The reverse operations enable shutoff of the compressed natural gas flow and detachment of the nozzle from the filling receptacle 140. Namely, the second lever or trigger 132 is first de-actuated by flipping the locking tab 226 down and permitting the spring 224 to return the poppet 184 to its sealed position. Then the safety hook 216 is released from the trigger 130, and the spring 164 within the filling receptacle 140 pushes its shutoff valve closed and in turn pushes the valve assembly 180 rearward. In the process, the front shoulder 208*b* contacts and rotate the latch members 210 in a counter-clockwise (CCW) direction which disengages the clamping jaws 150 from the annular recess 152 and out of the way of the flange 144. The nozzle 120 can then be removed from the filling receptacle 140.

Figure 9:
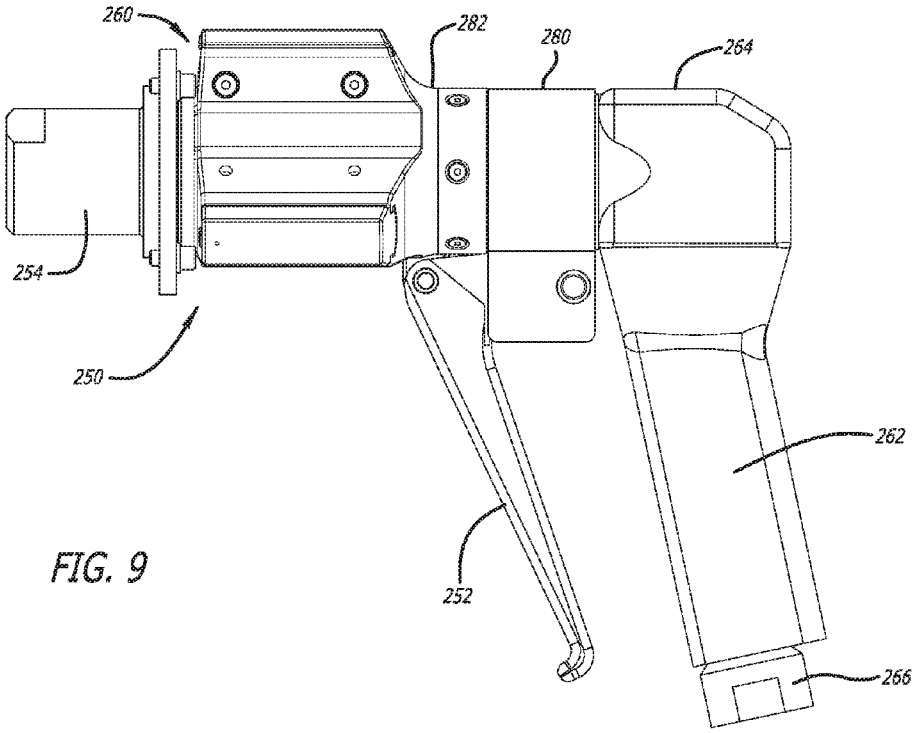
FIG. 9 a side elevational view of an exemplary gun-style compressed natural gas nozzle of the present application.

FIG. 9 a side elevational view of another exemplary gun-style compressed natural gas nozzle 250 of the present application. While the first embodiment of nozzle 120 included two triggers 130, 132—one for locking the nozzle to a filling receptacle, and a second trigger to control the flow of gas through the nozzle—the embodiment of FIG. 9 includes only one trigger 252 for locking nozzle to a filling receptacle 254. There is no control or metering of the gas flow, it is either ON or OFF.

The gun-style nozzle 250 is similar in many respects to the earlier-described gun-style nozzle 120, and includes a distal outlet end 260 that engages and locks the nozzle to the filling receptacle 254, which can be the same as the filling receptacle 140 shown above. The nozzle 250 has a gun-style with a handle 262 angled down and rearward from the back end of a horizontal barrel portion 264 that terminates at the outlet end 260. A connector 266 at the bottom of the handle 262 permits attachment of a compressed natural gas line or hose. In this regard, the gas flows up through the handle 262 and forward through the barrel portion 264 to the outlet end 260.

Figure 10A:
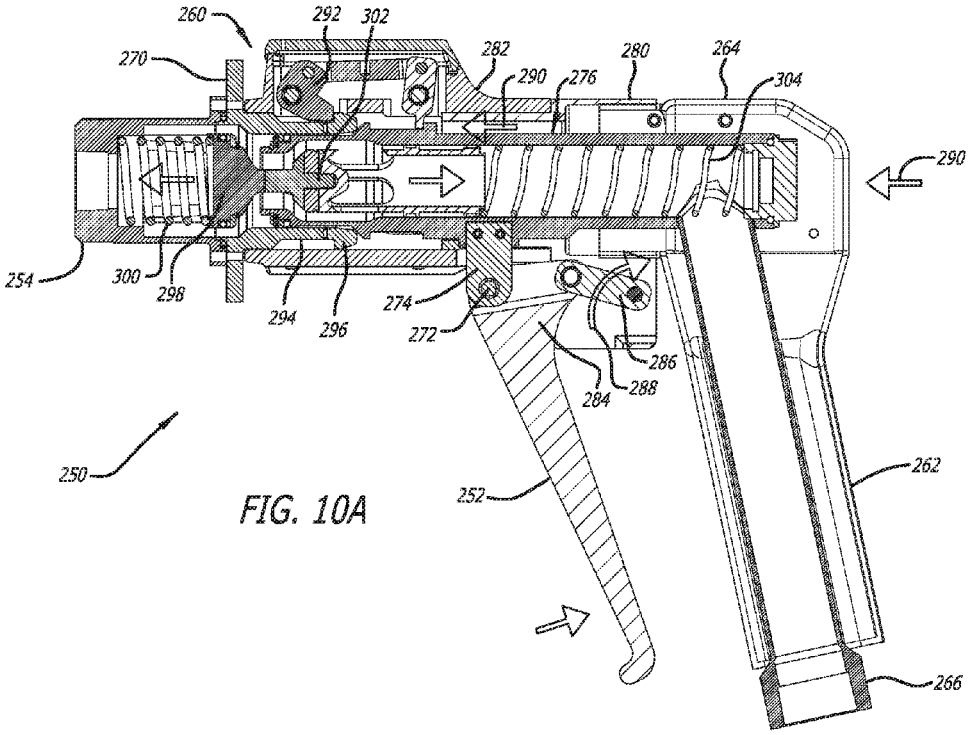
FIG. 10A-10C are vertical sectional views through the gun-style compressed natural gas nozzle of FIG. 9 during filling and retracted states.
Figure 10B:
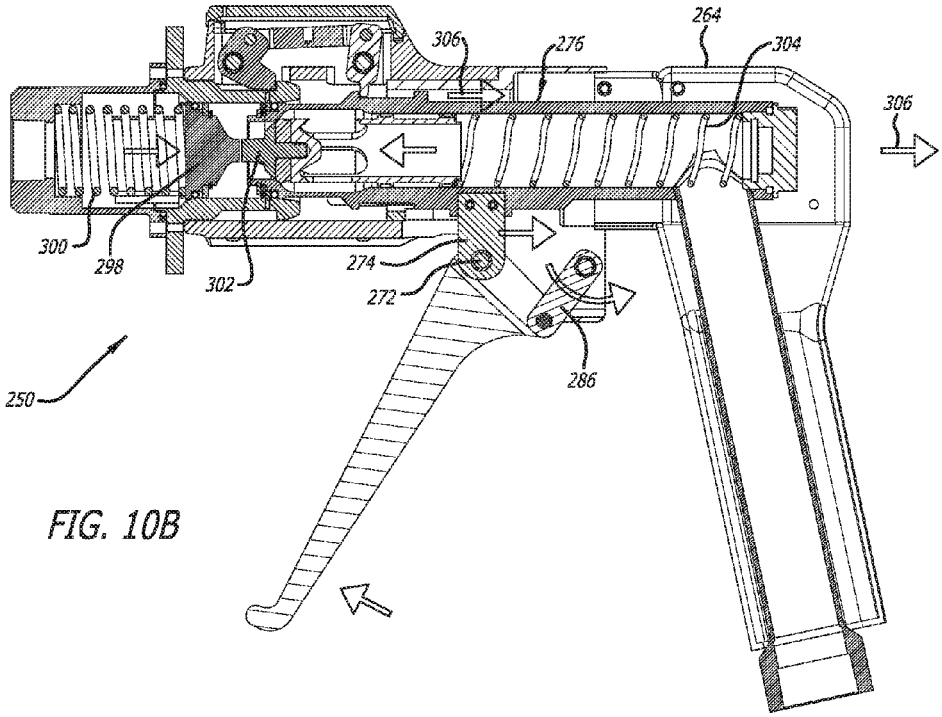
Figure 10C:
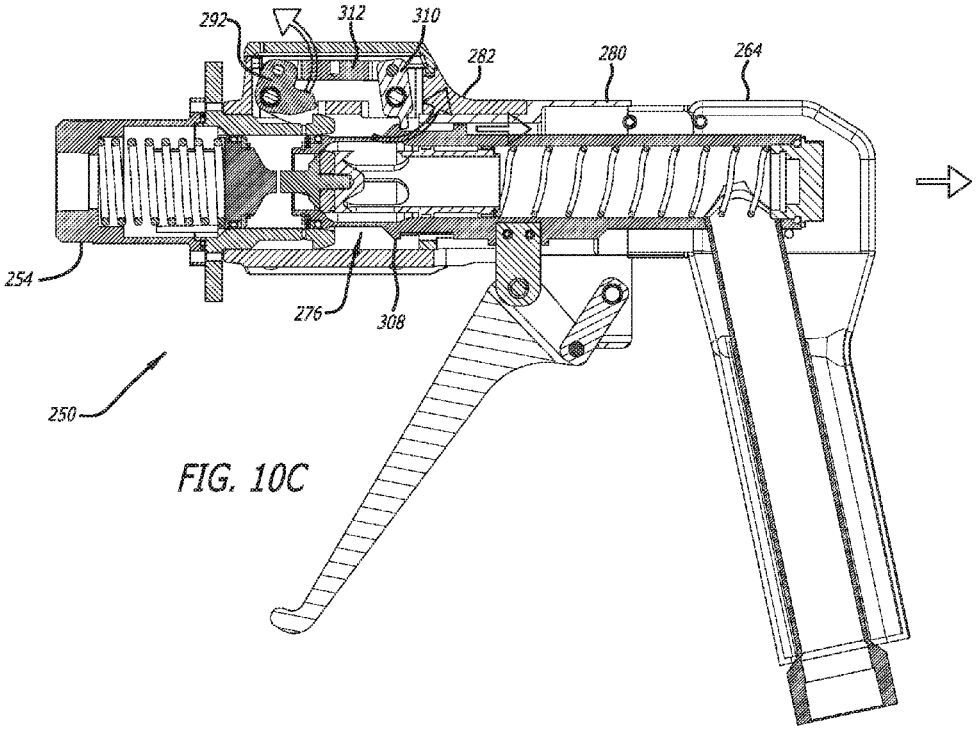

FIGS. 10A-10C are vertical sectional views through the gun-style compressed natural gas nozzle 250 of FIG. 9 during filling and retracted states. More specifically, FIG. 10A shows the nozzle 250 during an engaged and filling state, FIG. 10B shows the nozzle after a gas filling step but prior to disengagement of the nozzle from the filling receptacle 254, and FIG. 10C shows the nozzle disengaged from the filling receptacle.

With specific reference to FIG. 10A, the trigger 252 is actuated by squeezing it toward the handle 262, and the outlet end 260 of the nozzle 250 is shown abutted against an outward flange 270 of the filling receptacle 254. An upper end of the trigger 252 pivots about a fulcrum pin 272 fixed within a downwardly-depending barrel tab 274. The barrel tab 274, in turn, is fixed to the underside of a generally tubular valve assembly 276 via rivets or the like. The valve assembly 276 opens at a proximal end to a tubular downwardly-angled conduit 278 that extends through the handle 262 and terminates in the connector 266. As seen in FIGS.

9 and 10A, the valve assembly 276 as well as the horizontal barrel portion 264 in which it is held slide horizontally back and forth with respect to a tubular cam housing 280 which is in turn fixed to a forward latch housing 282 that terminates in the outlet end 260. In FIG. 10A the valve assembly 276 and horizontal barrel portion 264 are displaced as far to the left relative to the tubular cam housing 280 as possible, which is caused by squeezing the trigger 252 as explained below.

When the trigger 252 is squeezed, it pivots about the fulcrum pin 272 as indicated and an upper finger 284 moves upward and rotates a linkage arm 286 as indicated by arrow 288. The linkage arm 286 pivotally rotates about a pin (not numbered) fixed with respect to the cam housing 280, and the rotational path of the left end thereof displaces the upper finger 284 to the left. Since the upper finger 284 is generally horizontally aligned with the fulcrum pin 272, the fulcrum pin 272 and the barrel tab 274 are also displaced to the left. This pulls the entire connected system of the horizontal barrel portion 264 and internal valve assembly 276 to the left, as indicated by the arrows 290.

The nozzle 250 automatically locks onto the filling receptacle 254 when the trigger 252 is squeezed. This occurs through inward pivotal movement of a plurality of clamping jaws 292 such that a pawl end of each enters an annular recess 294 in a tubular extension of the filling receptacle 254 and interferes with an annular flange 296. There are preferably three such jaws 292 that prevent separation of the nozzle 250 and filling receptacle 254. In a preferred embodiment, the three jaws 292 are all spring-biased to rotate into the locked condition via springs (not shown).

Once locked into place, a plug member 298 having a one or more O-ring seals (not numbered) that contact an internal narrowing in the filling receptacle 254 is opened against the force of coil spring 300 to permit flow of compressed gas through the receptacle. At the same time, a poppet 302 in a tubular horizontal portion of the valve assembly 276 is displaced to the right by the plug member 298 after it bottoms out against a hard stop within the filling receptacle 254. The poppet 302 is normally biased toward the left by a coil spring 304 such that its distal end seals the distal end of the valve assembly 276 and prevents the flow of gas. A distal nose of the poppet 302 extends distally from the valve assembly 276 to directly contact the plug member 298. Consequently, nearly simultaneously both valves within the filling receptacle 254 and internal valve assembly 276 are opened and the nozzle 250 is locked to the receptacle when the trigger 252 is squeezed. The two valves open fully upon this action, and there is no control over the amount of gas flow, unlike in the first embodiment.

Once the desired quantity of gas is delivered to the tank or whatever container is being filled, the user releases the trigger 252 as seen in FIG. 10B. Through the connected fulcrum pin 272, barrel tab 274 and linkage arm 286, this pulls the entire connected system of the horizontal barrel portion 264 and internal valve assembly 276 to the right, as indicated by the arrows 306. This permits both the plug member 298 in the filling receptacle 254 and the poppet 302 in the valve assembly 276 to shut under the force of respective springs 300, 304. In the position shown in FIG. 10B, the flow of gas is shut off for a moment prior to release of the nozzle 250 from engagement with the filling receptacle 254 to enable any built-up pressure in between to dissipate. More specifically, the clamping jaws 292 remain rotated into engagement with the annular flange 296 of the filling receptacle 254.

Finally, FIG. 10C shows movement of the horizontal barrel portion 264 and internal valve assembly 276 slightly more to the right away from the tubular cam housing 280 and forward latch housing 282. This causes a shoulder 308 on the exterior of the valve assembly 276 to contact and displace to the right a small finger on the inner end of a plurality (preferably three) of toggle members 310 within the latch housing 282. Each toggle member 310 rotates about a fixed pivot and has an outer end pivotally connected to a linkage arm 312 which is also pivotally connected to one of the clamping jaws 292. As seen by the rotation arrows (not numbered), engagement of the shoulder 308 with the toggle members 310 releases the clamping jaws 292, thus permitting removal of the nozzle 252 from the filling receptacle 254. Further, another shoulder (not numbered) on the exterior of the tubular horizontal portion of the valve assembly 276 desirably contacts the small fingers on the inner ends of the toggle members 310 when the trigger 252 is pulled and the valve assembly 276 moves distally to cause the jaws 292 to engage, as seen in FIG. 10A. This is in conjunction with a spring biasing the jaws 292 to their engaged positions.

The following Table lists a number of elements shown and labeled with corresponding numbers in FIG. 8:

| PART NO. | PART NAME |
|---|---|
| 1 | LATCH HOUSING, NOZZLE, LNG |
| 2 | CAM HOUSING, NOZZLE, LNG (1) |
| 3 | ASSEMBLY, VALVE, GUN NOZZLE, LNG |
| 4 | LEVER, LATCHING HANDLE, NOZZLE, LNG |
| 5 | VALVE STEM, NOZZLE, LNG |
| 6 | SPACER, VALVE STEM, NOZZLE, LNG |
| 7 | SPACER, VALVE STEM, NOZZLE, LNG, .437 DIA. |
| 8 | JAW, CLAMPING, NOZZLE, LNG |
| 9 | LINK, ARM, NOZZLE, LNG |
| 10 | LEVER, NOZZLE, LNG 10 |
| 11 | LEVER, TRIGGER, NOZZLE (LNG) |
| 12 | PISTOL HOUSING, LNG (RIGHT HALF) |
| 13 | PISTOL HOUSING, LNG (LEFT HALF) |
| 14 | HOOK, SAFETY, NOZZLE (LNG) |
| 15 | LEVER LOCK, FILL |
| 16 | YOKE, VALVE CONTROL |
| 17 | VALVE BODY PLUG, NOZZLE (LNG) |
| 18 | NUT, RETAINER, ENERGIZED SEAL, NOZZLE (LNG) |
| 19 | TAB, BARREL, NOZZLE (LNG) |
| 20 | SEAL, PRIMARY, NOZZLE, (LNG) |
| 21 | COVER, DUST, NOZZLE (LNG) |
| 22 | PIN, LATCH |
| 23 | PIN, CAM |
| 24 | PIN, LEVER |
| 25 | BEARING, BUSHING, LEVER |
| 26 | BEARING, BUSHING, CAM |
| 27 | BEARING, BUSHING, LATCH |
| 28 | NUT, VALVE SEAL, BRONZE |
| 29 | RETAINING, RING, EXTERNAL, E TYPE, 0.343 FREE O.D. - .4375 SHAFT |
| 30 | RETAINING RING, EXTERNAL, E TYPE, 0.303 FREE O.D. - .375 SHAFT |
| 31 | SLEEVE, SPACER, VALVE STEM |
| 32 | BLOCK, TRIGGER LOCK |
| 33 | SCREW, TRIGGER SAFETY |
| 34 | SCREW, SHOULDER, SOCKET HD., .250 DIA × 1.125 L, 10-32, SS18-8 |
| 35 | SCREW, PAN HD, TORX, 8-32 × .750 L, SS 18-8 |
| 36 | SCREW, PAN HD, TORX, 8-32 × 1.000 L, SS 18-8 |
| 37 | SCREW, SOCKET HD. CAP, LOW PROF., 10-32 UNF × .25 L |
| 38 | SCREW, SOCKET HD. CAP, LOW PROF., 10-32 UNF × .375 L |
| 39 | INSERT, 8-32 × .312 LONG, BRASS |
| 40 | RING, RETAINING EXT 0.147 FREE ID × 0.029, .188 DIA |
| 41 | C-RINGS B18.27.2 NA6-25 |
| 42 | RIVET, SOLID, .156 DIA. × 1.00L, SS18-8 |
| 43 | WASHER, FLAT, .375, SS18-8 |

-continued

| PART NO. | PART NAME |
|---|---|
| 44 | PIN, DOWEL, .250 DIA. × 2.00 L, SS18-8 |
| 45 | PIN, COILED SPRING, 0.163 DIA. × .500 L, SS420 |
| 46 | BRASS SEAL RETAINER |
| 47 | RETAINING CLIP - POPPET |
| 48 | SEAL, 1.553" OD HEAT TREATED ELGILOY |
| 49 | O RING 2.0625 INCH ID × 2.250 INCH OD BUNA N |
| 50 | SEAL, ENERGIZED, LNG |
| 51 | COMPRESSION SPRING - LATCH |
| 52 | SPRING, VALVE, NOZZLE, LNG |
| 53 | SPRING, MAIN RECOIL, NOZZLE, LNG |
| 54 | SPRING, TORSION, LOCKING LEVER |

Figure 11A:
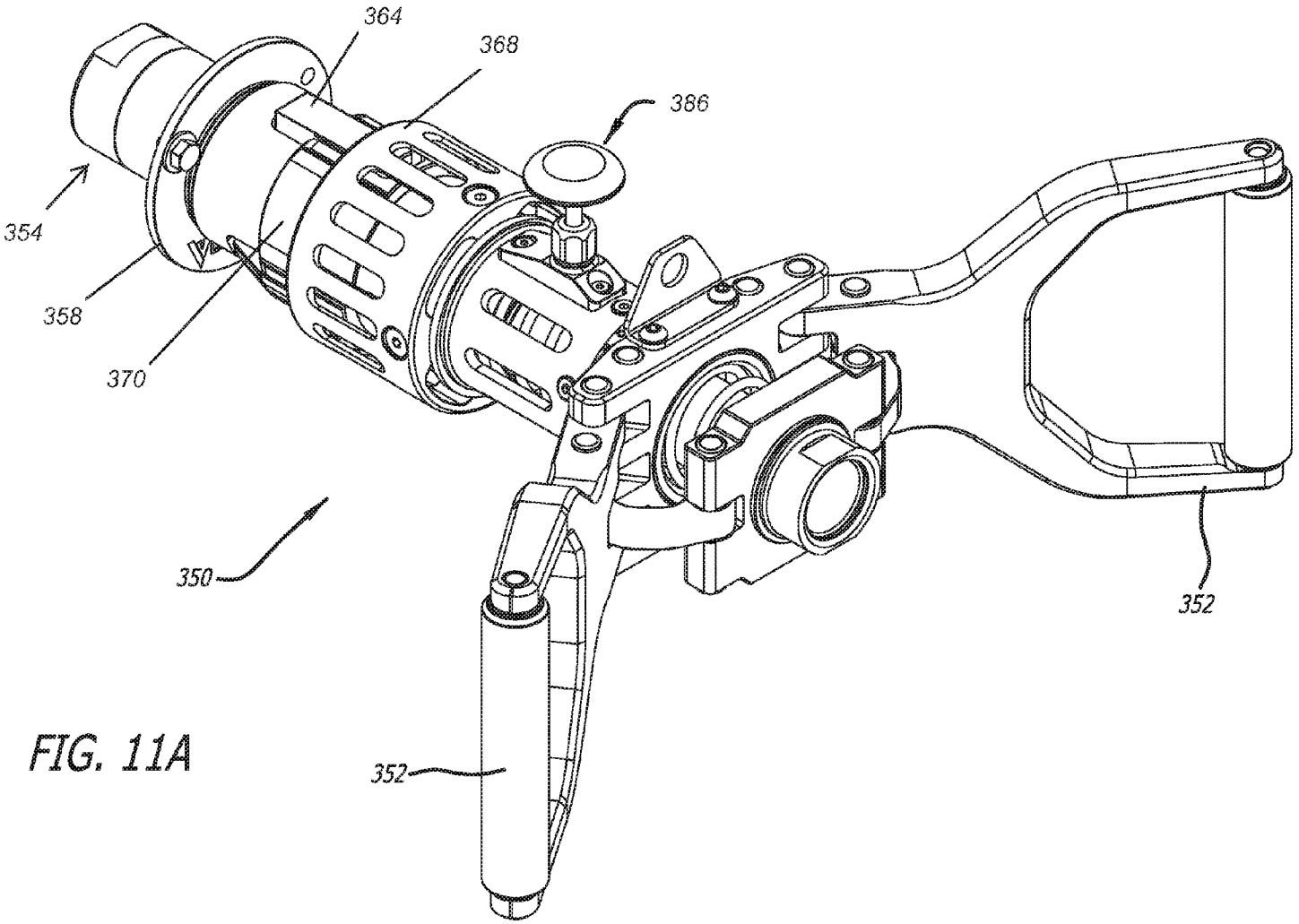
FIGS. 11A and 11B are perspective views showing two perspective views of an alternative two-handed compressed natural gas nozzle of the present application in unlocked positions.
Figure 11B:
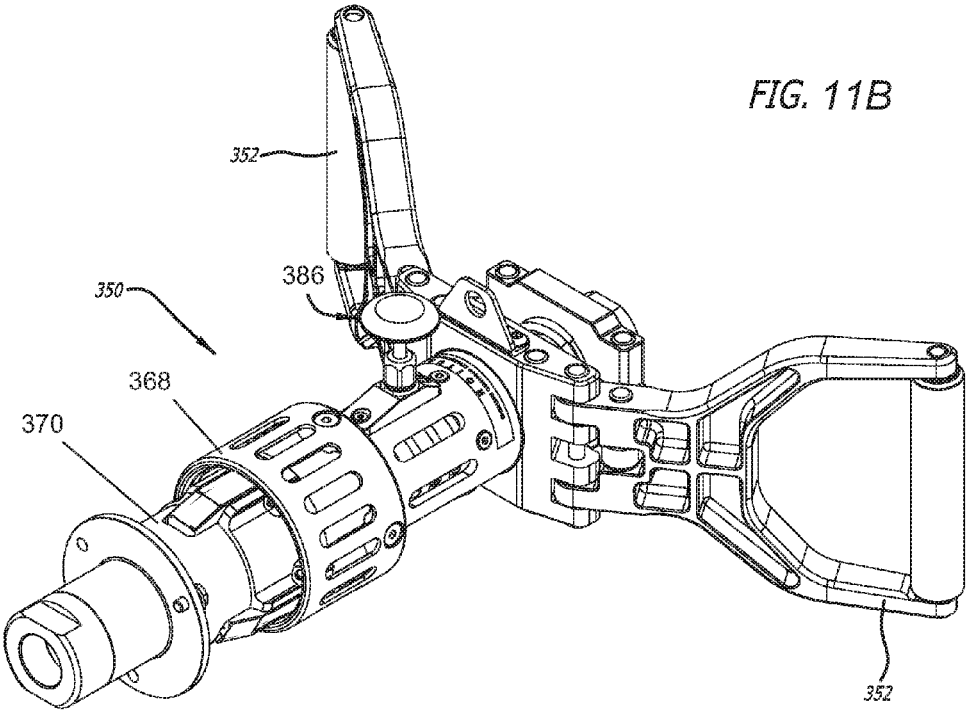
Figure 12:
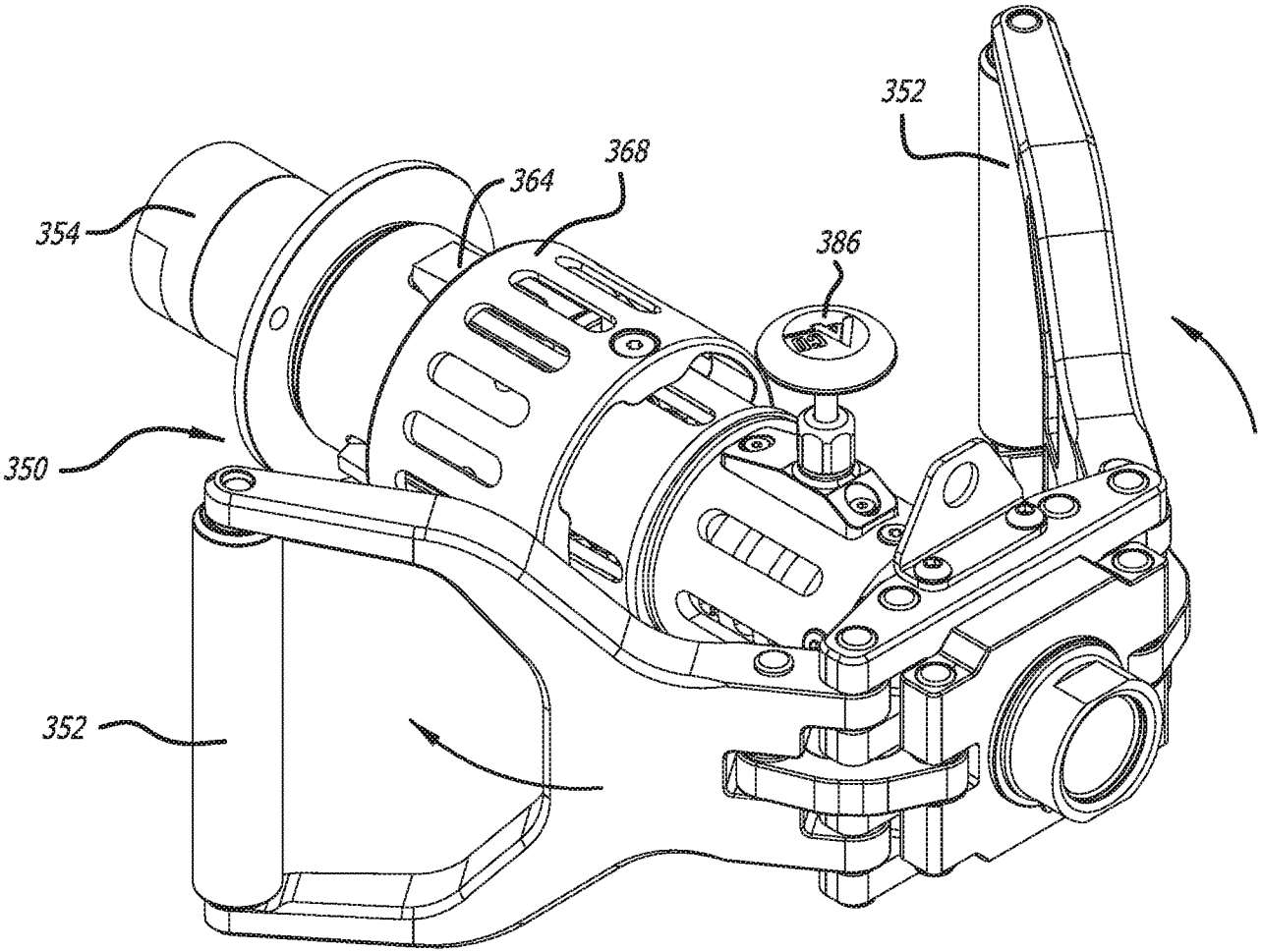
FIG. 12 is a perspective view showing the two-handed compressed natural gas nozzle in a locked position.

FIGS. 11A and 11B are two perspective views of an alternative compressed natural gas nozzle for use with two-hands in unlocked positions, and FIG. 12 shows the two-handed nozzle in a locked, fueling position. The nozzle 350 is similar in many respects to current two-handed nozzles, and includes two large handles 352 that engage and lock the nozzle to a filling receptacle 354. The filling receptacle 354 is representative of a number of different types of such receptacles, and typically includes a tubular extension 356 (see FIG. 13A) to which the nozzle 350 couples and an annular flange 358 marking the base of the tubular extension 356.

Figure 13A:
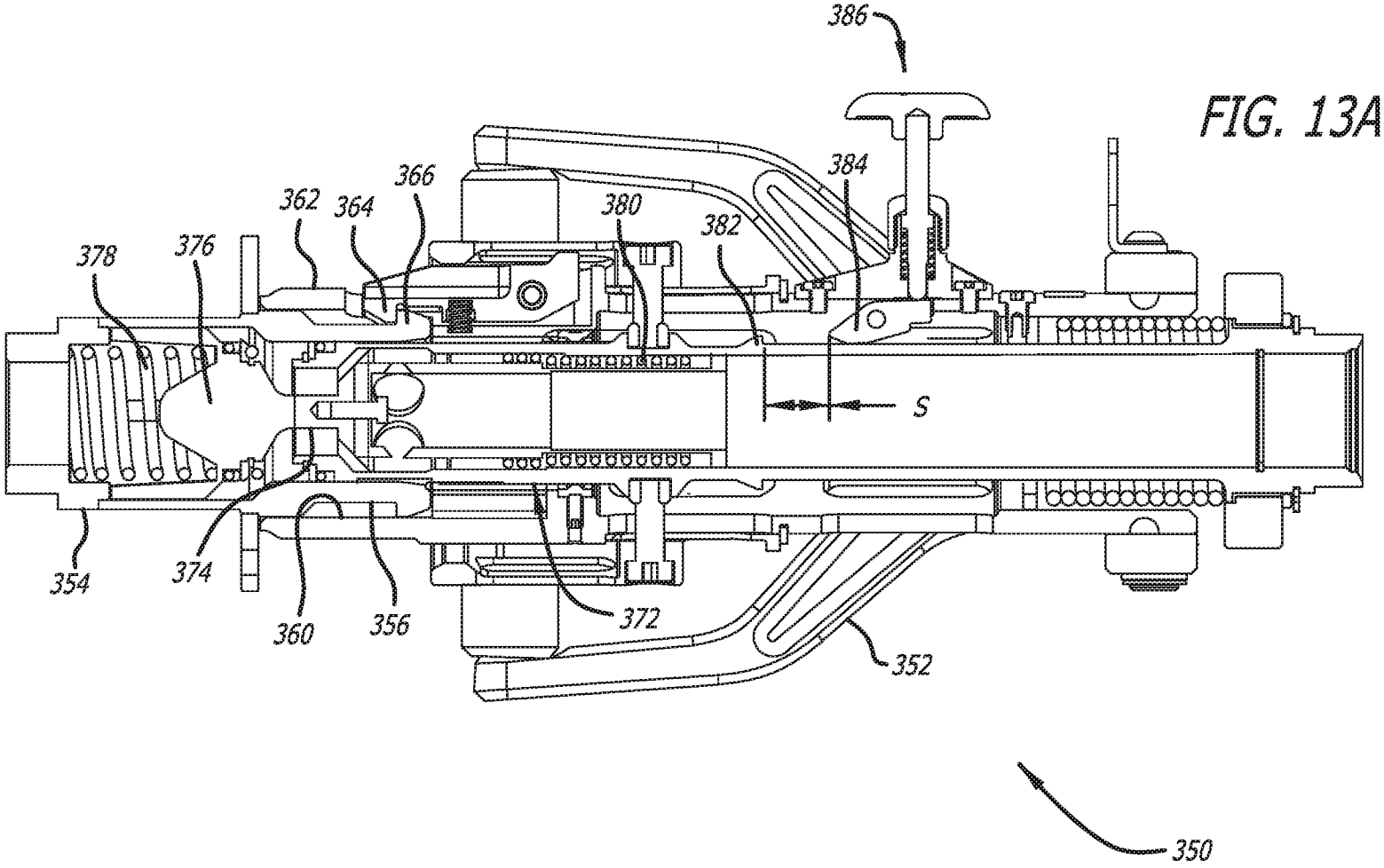
FIGS. 13A-13B are longitudinal sectional views through the two-handed compressed natural gas nozzle in various stages of operation.

With reference to FIG. 13A, the tubular extension 356 is sized to fit within an inner bore 360 (also see in FIG. 13B) of an outlet end 362 of the nozzle 350 until a forwardmost extent of the outlet end 362 abuts the annular flange 358. Pivoting the handles 352 from their positions in FIGS. 11A and 11B to that in FIG. 12 causes the nozzle 350 to lock onto the filling receptacle 354. Of course, there are various locking configurations for high pressure gas nozzles, the illustrated embodiment including inward movement of a plurality of clamping jaws 364 to engage a circular shoulder 366 on the tubular extension 356 of the filling receptacle. More specifically, forward pivoting of the handles 352 displaces an outer tubular sleeve 368 in a distal direction around a latch housing 370 within which the clamping jaws 364 are pivotally mounted, camming a distal end of the jaws inward. This can be seen from inspection of the different positions of the sleeve 368 and jaws 364 in FIGS. 11A and 12.

Figure 13B:
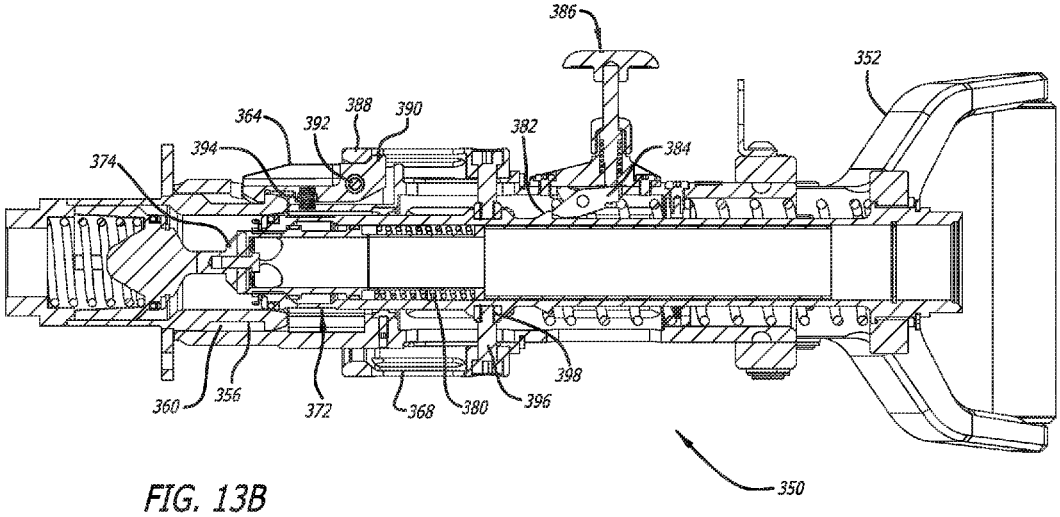

FIGS. 13A-13B are longitudinal sectional views through the two-handed compressed natural gas nozzle 350 in various stages of operation. First, FIG. 13A shows the nozzle 350 in a locked, fueling position with the jaws 364 pivoted inward to engage the shoulder 366 on the tubular extension 356. As long as the handles 352 remain forward, the assembly is locked and gas flows to whatever container is being filled. More particularly, a generally tubular inner valve assembly 372 is displaced in a distal direction by the movement of the handles such that a distal poppet 374 contacts and displaces a plug 376 in the filling receptacle 354 against the bias of a spring 378, thus opening the receptacle. At a certain displacement, the plug 376 bottoms out within the filling receptacle 354 and further movement of the valve assembly 372 cause the poppet 374 to move away from inner sealing surfaces of the valve assembly against the bias of a spring 380. Displacing both the plug 376 and the poppet 374 away from their respective sealing surfaces initiates gas flow.

The reader will notice in FIG. 13A the forward position of a circular shoulder 382 on the valve assembly 372 spaced a distance S from the distal end of a small toggle member 384 forming a part of a safety button 386, which will be described further below.

FIG. 13B shows the nozzle 350 in a lockout position after filling of the receiving container so as to permit gas venting prior to nozzle removal. The handles 352 have been partially retracted until the tubular valve assembly 372 displaces in a proximal direction away from the filling receptacle 354. This first permits the spring 378 in the filling receptacle 354 to close the plug 376, and then the spring 380 within the valve assembly 372 to close the poppet 374. This also moves the poppet 374 away from contact with the plug 376. The clamping jaws 364 remain engaged with the tubular extension 356 of the filling receptacle 354 by virtue of the forward position of the outer sleeve 368.

FIG. 13B shows an inward collar 388 on the sleeve 368 that is positioned just distal to an outward flange 390 on the proximal end of each locking jaw 364. The jaws 364 each pivot on an axle 392 and are biased in a clockwise direction as shown in the figures by a spring 394. That is, the jaws 364 are biased to their open positions. However, the continued presence of the surrounding sleeve 368 prevents the distal end of the jaws 364 from pivoting outward and disengaging from the tubular extension 356 of the filling receptacle 354. A plurality of bolts 396 secured to the sleeve 368 extend radially inward into cooperation with the exterior of the tubular valve assembly 372 and hold the sleeve in this partially retracted position. The valve assembly 372 may have a groove 398 formed thereon, for example, into which inner ends of the bolts 396 extend.

From the partially retracted position of FIG. 13B, interaction between the circular shoulder 382 on the valve assembly 372 and the distal end of a small toggle member 384 of the safety button 386 prevents further proximal movement of the tubular valve assembly 372. The toggle member 384 is biased by a spring (not shown) into this position such that it automatically prevents full retraction of the valve assembly 372. In this configuration, with the two valves closed, any residual pressurized gas within the internal spaces in the nozzle dissipates quickly. This prevents the entire nozzle 350 from being propelled in a backward direction from the pressure of the residual gas as it is not entirely decoupled from the filling receptacle 354. Prior two-handed nozzles disengage immediately when the handles are pulled back, thus creating a danger of the nozzle shooting back into the user from the residual pressurized gas.

Figure 13C:
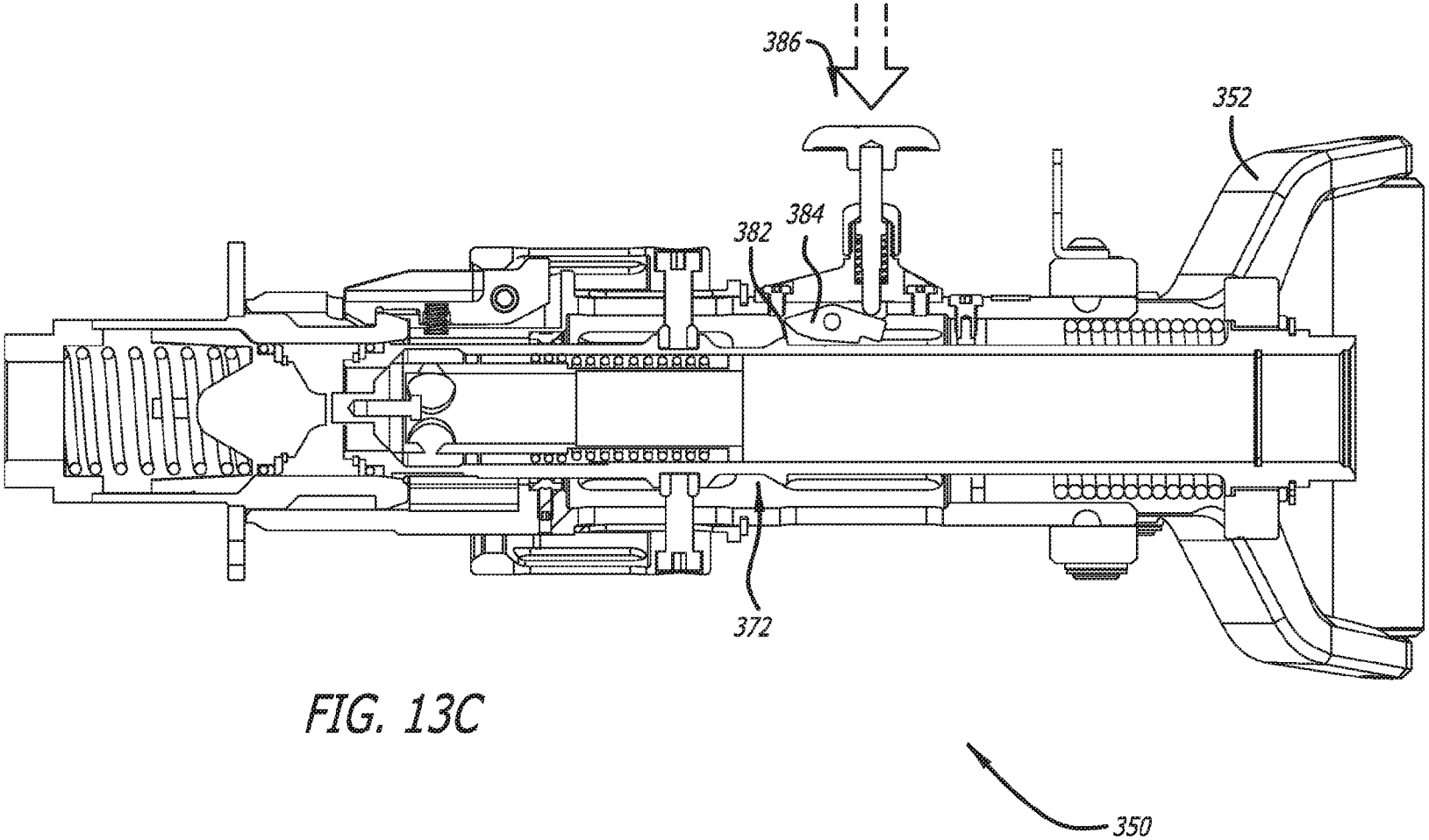
FIG. 13C is a longitudinal sectional view through the two-handed compressed natural gas nozzle showing actuation of a safety button.

FIG. 13C shows actuation of the safety button 386 by pushing it radially inward. This causes pivoting movement of the toggle member 384 such that its distal end swings out of the way of the circular shoulder 382 on the valve assembly 372.

Figure 13D:
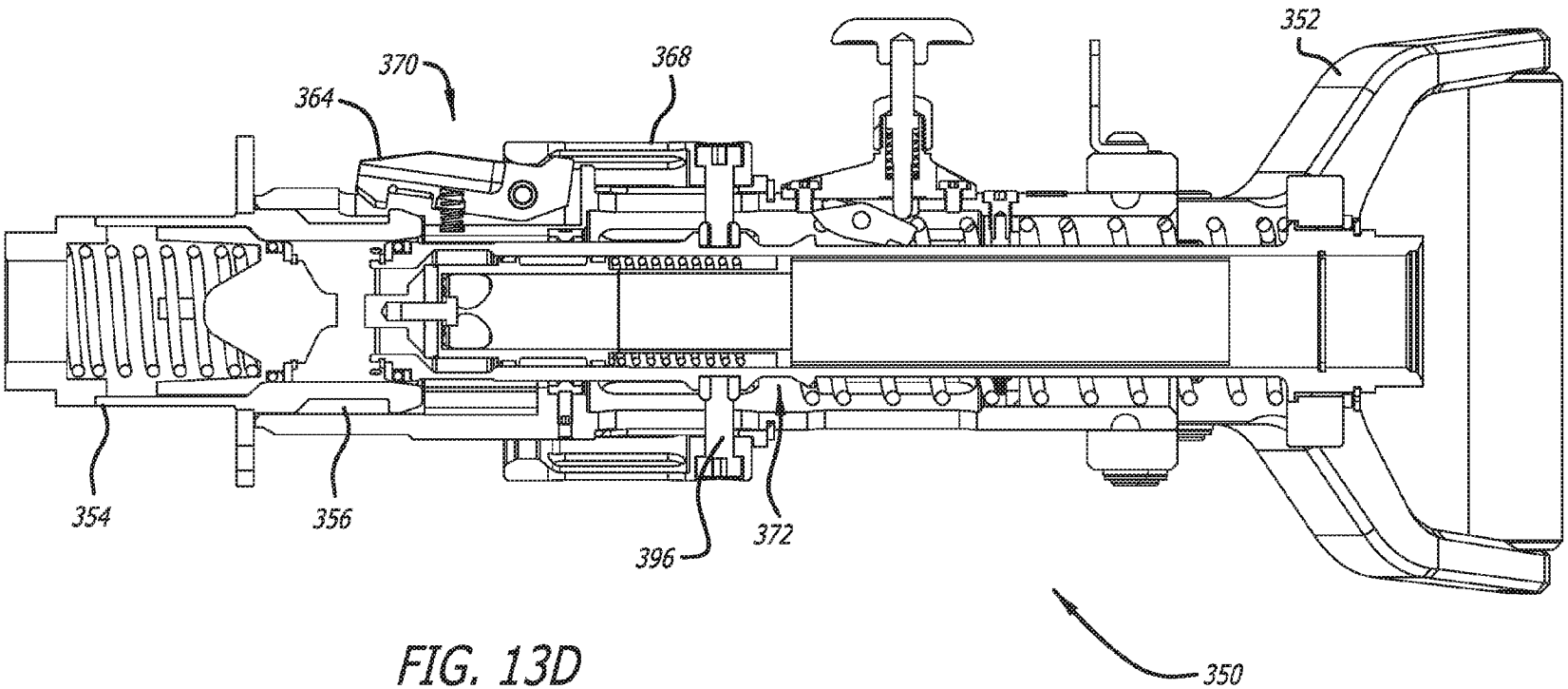
FIG. 13D is a longitudinal sectional view through the two-handed compressed natural gas nozzle showing the nozzle in a removal position.

FIG. 13D shows the nozzle 350 in a removal position with the handles 352 fully retracted to pull back the valve assembly 372, which also pulls back the sleeve 368 from around the latch housing 370 due to the intermediate bolts 396. Consequently, the clamping jaws 364 are biased open to release the tubular extension 356 of the filling receptacle 354.

The button 386, preferably red in color, on the top of the nozzle 350 provides a safety lockout release. When disengaging the nozzle 350 from the receptacle after filling, the two handles 352 are pulled towards the operator. The nozzle jaws 364 remain engaged while the nozzle de-pressurizes safely. To further retract the jaws 364 to remove the nozzle 350 from the fill receptacle 354 the red button 386 is pushed to release the lockout feature. The safety lockout button 386 prevents the nozzle from bursting off of the fill receptacle when disengaging or discontinuing filling. Of course, a button to displace the toggle member 384 out of the way may be replaced by a lever, a slider, even an electric switch, and the term "safety switch" shall be used to encompass these and other such actuators. Indeed, the pivoting spring-loaded toggle member 384 is shown in an exemplary embodiment, but could also be replaced with a radially movable member, a gear mechanism, a solenoid, etc., and the term "toggle member" refers to these alternatives and others within the skill in the art.

Figure 14:
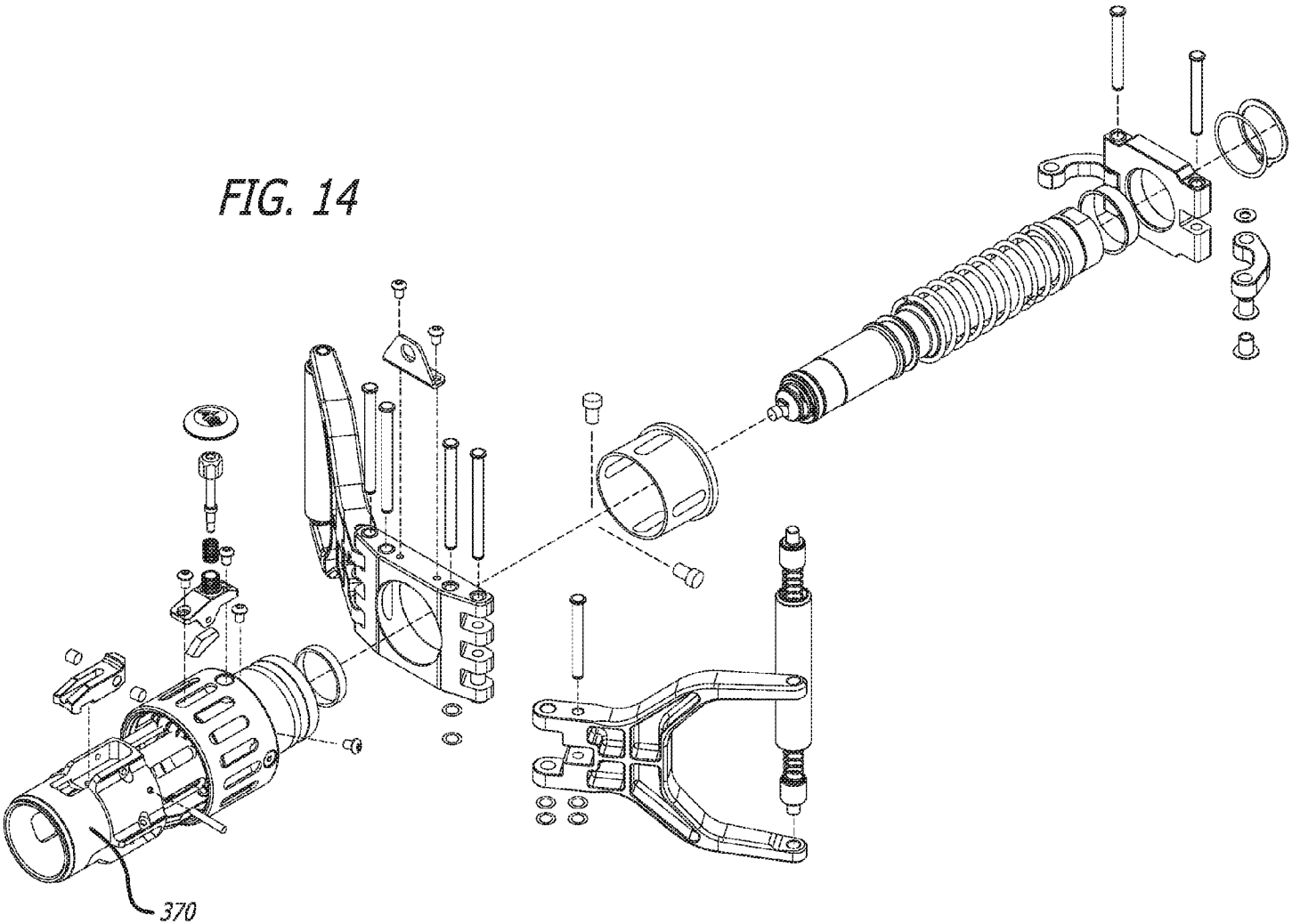
FIG. 14 is an exploded perspective view of components of the two-handed compressed natural gas nozzle.

FIG. 14 is an exploded perspective view of components of the exemplary two-handed compressed natural gas nozzle of FIGS. 11-13.

The following Table lists a number of elements shown and labeled with corresponding numbers in FIG. 14:

| Part | |
|---|---|
| 1 | BODY, MAIN, LNG NOZZLE |
| 3 | HANDLE, GRIP, LNG FUELING NOZZLE, 2G |
| 4 | LINK, ARM, LNG FUELING NOZZLE |
| 5 | BASE, LNG FUELING NOZZLE |
| 7 | BASE, LOCKOUT, NOZZLE LNG |
| 8 | NUT, LOCKOUT, NOZZLE LNG |
| 9 | STEM, LOCKOUT, NOZZLE LNG |
| 10 | SLEEVE, WEAR, NOZZLE, LNG |
| 11 | SLEEVE, BEARING, NOZZLE, LNG |
| 12 | ASSEMBLY, FILL TUBE, LNG NOZZLE |
| 13 | SLEEVE, LOCKING, LNG NOZZLE |
| 14 | LATCH |
| 15 | BASE, MOUNTING, FILL TUBE, LNG NOZZLE |
| 16 | BRONZE BEARING, LATCH |
| 17 | SHAFT, LATCH |
| 18 | PIN, NOZZLE HANDLE (LNG) |
| 19 | PIN, NOZZLE, LNG, 2.575 IN. LONG |
| 20 | PIN, NOZZLE, LNG, 3.515 IN. LONG |
| 21 | BUSHING, BRONZE, NOZZLE, LNG |
| 22 | WASHER, FLAT, ID. .316 × O.D. .625, BRASS |
| 23 | RING, SPRING SUPPORT |
| 24 | WASHER, RET. RING |
| 25 | RING, WEAR, NOZZLE LNG |
| 26 | BRACKET, MOUNT, NOZZLE, LNG |
| 27 | RING, RETAINING, EXT 1.675 FREE ID × .062 THK., FOR 1.708 DIA |
| 28 | RING, RETAINING, EXT 2.428 FREE ID × .078 THK., FOR 2.625 DIA |
| 29 | SCREW, BEARING, BRONZE, .250-28 UNF 2A |
| 30 | COLLAR, NOZZLE LNG lower half |
| 31 | BUTTON, LOCKOUT, NOZZLE LNG |
| 32 | RETAINING CLIP - LATCH |
| 33 | COMPRESSION SPRING - LATCH |
| 34 | SPRING HOUSING |
| 35 | SPRING, COMPRESSION, 0.600 O.D. × 2.00 L, ZINC STL. |
| 36 | SCREW, SHOULDER, .250-20 UNC, 0.3125 DIA, × .625 LONG |
| 37 | SPRING, TORSION, LOCKING LEVER |
| 38 | SCREW, SOCKET HD. CAP, LOW PROF., 10-32 UNF |
| 39 | COM SCREW SET 8-32 UNC-2AX0.3750 LONG ALLEN HD CUP PT |
| 40 | SCREW, SET, SOCKET HD, .138-32x .125-HX-SST18-8 |
| 41 | SCREW CAP 0.2500-20 UNC-2A 0.3750 LONG BUTTON HEAD |
| 42 | WASHER, FLAT BRASS |
| 43 | RETAINING CLIP |
| 44 | SCREW, SOCKET HEAD CAP, 6-32 UNC 2A, .500 LONG, SS18-8, |
| 45 | SPRING COMPRESSION, 2.077 O.D. × .156 WIRE DIA. |
| 46 | PIN DOWEL 0.1875 DIA × 0.7500 LONG SS18-8 |
| 47 | LABEL, CAUTION |
| 48 | ARM, HANDLE, LNG FUELING NOZZLE (MACHINED) |
| 49 | LATCH, SAFETY, NOZZLE LNG |

CLOSING COMMENTS

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A high pressure filling nozzle for one-handed dispensing of cryogenic gaseous fluids into a filling receptacle having a tubular extension and a spring-biased plug therein, comprising:

a gun-style housing having a proximal handle through which passes a gas conduit terminating in a connector for a pressurized cryogenic gas supply angled with respect to a distal barrel portion aligned in a proximal-distal direction, the distal barrel portion terminating in an outlet end sized to receive the tubular extension of the filling receptacle and the handle and gas conduit being movable in the proximal-distal direction with respect to the barrel portion;

a valve assembly fixed with respect to the handle and being adapted to slide within and along the barrel portion, the valve assembly having a proximal end open to the gas conduit and an internal poppet at a distal end that is biased into a closed position by an internal spring;

a locking trigger mounted to a pivot point so as to enable pivoting toward and away from the handle and is connected to the valve assembly and barrel portion in a manner such that squeezing the locking trigger displaces the valve assembly in a distal direction within the barrel portion and toward the outlet end, the locking trigger being adapted to be actuated by one hand by a person squeezing the trigger and the handle; and a distal latch housing forming a part of the barrel portion and surrounding the valve assembly, the latch housing having a plurality of clamping jaws that engage and lock to the tubular extension of the filling receptacle when the valve assembly is displaced in a distal direction within the barrel portion and toward the outlet end, and wherein displacement of the valve assembly in a distal direction within the barrel portion and toward the outlet end also opens both the spring-biased plug in the filling receptacle and the poppet in the valve assembly against the force of the internal spring to enable a flow of cryogenic gas through the filling receptacle, wherein the latch housing includes a mechanism for each clamping jaw that coordinates movement of the valve assembly with movement of the clamping jaws, including a pivoting latch member that extends inward to interfere with a shoulder on an exterior of the valve assembly that contacts and displaces the latch member in a proximal direction to cause disengagement of an associated clamping jaw, wherein an outer end of the latch member rotatably connects to a link arm which is also rotatably journaled to an associated clamping jaw.

2. The nozzle of claim 1, wherein the locking trigger pivot point is fixed with respect to the valve assembly such that the locking trigger moves with the valve assembly.

3. The nozzle of claim 2, wherein the locking trigger has an upper finger pivotally connected to a linkage arm fixed with respect to the barrel portion.

4. The nozzle of claim 1, wherein there are three clamping jaws and associated mechanisms within the latch housing.

5. The nozzle of claim 1, wherein the clamping jaws are each spring biased into a position where they engage and lock to the tubular extension.

6. The nozzle of claim 5, wherein further including a second shoulder on the exterior of the valve assembly that contacts and displaces the latch members in a distal direction to cause engagement of the clamping jaws.

7. The nozzle of claim 1, wherein the poppet extends to a distal end of a tubular horizontal portion of the valve assembly and terminates in a distal nose that extends distally from the valve assembly to directly contact the spring-biased plug in the filling receptacle when the valve assembly is displaced in a distal direction.

* * * * *